US006139765A

United States Patent [19]

Kitazawa et al.

[11] Patent Number: 6,139,765

[45] **Date of Patent: *Oct. 31, 2000**

[54] MAGNETIC POWDER, PERMANENT MAGNET PRODUCED THEREFROM AND PROCESS FOR PRODUCING THEM

[75] Inventors: Atsunori Kitazawa; Toshiyuki Ishibashi; Koji Akioka, all of Suwa, Japan

[73] Assignee: Seiko Epson Corporation, Tokyo, Japan

[ * ] Notice: This patent is subject to a terminal disclaimer.

[21] Appl. No.: 08/845,477

[22] Filed: Apr. 25, 1997

Related U.S. Application Data

[63] Continuation-in-part of application No. 08/303,233, Sep. 8, 1994, Pat. No. 5,647,886.

[30] Foreign Application Priority Data

Nov. 11, 1993 [JP] Japan ..... 5-282717
May 11, 1994 [JP] Japan ..... 6-97682

[51] Int. Cl.[7] ..... H01F 1/04; H01F 1/14

[52] U.S. Cl. ..... 252/62.55; 252/62.54; 148/301; 148/302; 148/104; 75/252; 75/254; 75/255; 419/12; 419/13; 419/14

[58] Field of Search ..... 75/252, 254, 255; 148/301, 302, 104; 252/62.54, 62.55; 419/12, 13, 14

[56] References Cited

U.S. PATENT DOCUMENTS 4,601,754 7/1986 Ghandehari ..... 75/252
5,281,250 1/1994 Hamamura et al. ..... 75/255

FOREIGN PATENT DOCUMENTS 58-108708 6/1983 Japan .
59-106106 6/1984 Japan .
60-218445 11/1985 Japan .
64-22696 1/1989 Japan .
64-25819 1/1989 Japan .
64-40483 2/1989 Japan .
1-274401 11/1989 Japan .
4-36613 6/1992 Japan .
4-293708 10/1992 Japan .
5-105915 4/1993 Japan .
5-144621 6/1993 Japan .
5-152116 6/1993 Japan .
5-234732 9/1993 Japan .
2 232 165 12/1990 United Kingdom .
92/15995 9/1992 WIPO .

OTHER PUBLICATIONS

"Partial Substitution of Sm With Neodymium in $RE_2(TM)_{17}$ Resin Bonded Magnets," Journal of Magnetics Society of Japan, vol. 11, No. 2, pp. 243–246 (1987).

"Partial Substitution of Sm With Praseodymium in $R_2(TM)_{17}$ Resin Bonded Magnets," Journal of Japan Society of Powder and Powder Metallurgy, vol. 35, No. 7, pp. 584–588 (1988).

"Intrinsic magnetic properties of $R_2Fe_{17}C_yN_x$ compounds: (R=Y, Sm, Er, and Tm)", J. Appl. Phys. 70(4), pp. 2272–2282 (1991).

"Effect of Nitrogen Content on Magnetic Properties of $Sm_2Fe_{17}N_x$ (0<x<6)", IEEE Transactions on Magnetics, vol. 8, No. 5, pp. 2326–2331 (1992).

R. Skomski et al., "Giant Energy Product in Nanostructured Two–phase Magnets," Physical Review B: Condensed Matter, vol. 48, No. 21, pp. 15812–15816 (1993).

*Primary Examiner*—John Sheehan
*Attorney, Agent, or Firm*—Oliff & Berridge, PLC

[57] ABSTRACT

A magnetic powder and a permanent magnet are provided which have magnetic properties enhanced by magnetic interaction. Disclosed are a magnetic powder comprising a mixture of two or more powders including a magnetic powder A (residual magnetic flux density: BrA, coercive force: HcA) and a magnetic powder B (residual magnetic flux density: BrB, coercive force: HcB) of which the residual magnetic flux densities and the coercive forces have the following relationships: BrA>BrB and HcA<HcB, and a bonded magnet or a sintered magnet produced from the magnetic powder, and a method for mixing magnetic powders and a process for producing a magnet.

15 Claims, 10 Drawing Sheets

MAGNETIC POWDER, PERMANENT MAGNET PRODUCED THEREFROM AND PROCESS FOR PRODUCING THEM

This is a Continuation-in-Part of application No. 08/303,233, filed Sep. 8, 1994, now U.S. Pat. No. 5,647,886.

BACKGROUND OF THE INVENTION

This invention relates to a magnetic powder and a permanent magnet having magnetic properties enhanced by taking advantage of a magnetic interaction and a process for producing them.

In general, permanent magnetic materials have a tendency that an enhancement in saturation magnetization (or residual magnetic flux density) is not compatible with a high coercive force. More specifically, the following tendency is observed.

Soft magnetic materials are those materials which have a high saturation magnetization. For example, prmendur has such a high saturation magnetization of 24 kG. It, however, has little or no coercive force.

On the other hand, hard magnetic materials with a high coercive force, however, have much lower saturation magnetization than that of the soft magnetic materials. Among the hard magnetic materials, $R_2Fe_{14}B$-based, $R_2Fe_{17}N_x$-based and $R_2TM_{17}$-based materials have a relatively high saturation magnetization.

In the $R_2Fe_{14}B$-based materials, in order to enhance the saturation magnetization, it is necessary to reduce the volume fraction grain boundary phase and maximize the volume fraction of the $R_2Fe_{14}B$ phase as a main phase. A volume reduction in the grain boundary phase, however, makes it difficult to separate each grain of main phase, resulting in a low coercive force. When R is Nd, a high saturation magnetization is obtained. On the other hand, in order to obtain a high coercive force, it is a common practice to substitute Dy or the other heavy rare earth element for part of Nd. The substitution with Dy lowers the saturation magnetization.

The saturation magnetization of the $R_2Fe_{17}N_x$-based material (particularly when R=Sm) is nearly equal to that of $Nd_2Fe_{14}B$. However, in order to obtain a coercive force, the powder particle diameter must be pulverized to several $\mu$m, so that the coercive force obtained is substantially small for practical use. Further, since the material has to be a finely milled, when it is compacted into a bonded magnet or the like, the packing density of magnetic powder can't be raised. The addition of V, Mn or the like makes it possible to obtain a high coercive force in a relatively large powder particle diameter. It, however, results in a lowered saturation magnetization.

$R_2TM_{17}$-based (particularly R=Sm) bonded magnets are reported in many documents such as Japanese Patent Publication Nos. 22696/1989, 25819/1989 and 40483/1989 and patents and papers cited therein. Especially, an attempt to increase the Fe content of TM has been made as a means for improving the performance of this system. In this attempt, as described in FIG. 2 of Proc. 10th Int. Workshop on Rare Earth Magnets and Their Applications, 265 (1989), the maximum energy product $(BH)_{max}$ shows a peak value when the Fe content is a certain value. As suggested in Proc. of 11th Rare Earth Research Cont., 476 (1974), this is attributable to the fact that an increase in Fe content contributes to an increase in saturation magnetization but unfavorably lowers the magnetic anisotropy. For $Sm_2Co_{17}$-based bonded magnets having a high Fe content, as described in Proc. of ICF6, (1992) p1050–1051, fine cast structure and optimum heat treatments prevent a lowering in coercive force and squarensess (due to the increase in Fe content), so that increase the performance. Further, as reported in Japanese Patent Laid-Open No. 218445/1985 and papers, in some cases, an improvement in performance is attempted by employing, as Rare Earth element, Sm part of which has been substituted with other Rare Earth elements rather than use of Sm alone. As described in FIG. 1 of IEEE Trans. Mag. MAG-20, 1593 (1984), Table 1 of IEEE Trans. Mag. MAG-15, 1762 (1979) and some documents, among R's, a Pr or Nd substituted system can increase the saturation magnetization in accordance with an increase in substituted volume, but results in a lowering in magnetic anisotropy. Bonded magnets comprising the above composition system are described in Journal of The Magnetics Society of Japan, 11, 243 (1987), Journal of the Japan Society of Powder and Powder Metallurgy, 35, 587 (1988) and the like.

Bonded magnets produced by mixing two rare earth magnetic powders together are disclosed in Japanese Patent Laid-Open Nos. 144621/1993 and 152116/1993 and the like. The bonded magnet disclosed in Japanese Patent Laid-Open No. 144621/1993 (Applicant: Tokin Corp.) comprises a mixture of an $R_2Fe_{17}N$-based powder with an $R_2Co_{17}$-based powder, and the bonded magnet disclosed in Japanese Patent Laid-Open No. 152116/1993 comprises a mixture of an $R_2Fe_{17}N$-based powder with an $R_2Fe_{14}B$-based powder. However, neither information on coercive force of the mixed powder nor an improvement in magnetic properties by magnetic interaction among powder particles is disclosed, and the improvement in magnetic by mixing relies entirely upon an enhancement in packing density of magnetic powder (see Japanese Patent Laid-Open No. 144621/1993 on page 2, right col., line 24 and Japanese Patent Laid-Open No. 152116/1993 on page 2, right col., line 34 to page 3, left col., line 9). Furthermore, Japanese Patent Laid-Open No. 36613/1992 discloses that powders different from each other in particle diameter and coercive force are mixed together. But in this proposal, the coercive force and the particle diameter are not limited at all, and nothing is mentioned on an improvement in squareness by the magnetic interaction.

In recent years, the magnetic materials called an "exchange spring magnets" have been reported in the art. These magnets comprise a soft magnetic phase and a hard magnetic phase. The thickness of the soft magnetic phase is made smaller than the domain wall width of the soft magnetic phase to inhibit the magnetization reversal of the soft magnetic phase, thereby enabling coercive force to be increased. More specifically, $\alpha$Fe-$Nd_2Fe_{14}$ B, $Fe_3B$-$Nd_2Fe_{14}B$, $\alpha$Fe-$Sm_2Fe_{17}N_x$ and other materials have been reported. In the above exchange spring magnets, the phases must be crystallographically coherent. Among processes for producing the above materials include rapid quenching and mechanical alloying. These production processes impose restriction on a combination of the soft magnetic phase with the hard magnetic phase. Further, the structure renders the squareness low. Furthermore, at the present time, these magnetic materials which could have successfully produced in the art are isotropic, and anisotropic magnetic materials have not been reported at all.

Accordingly, the conventional permanent magnets had the following problems.

(1) An increase in saturation magnetization gives rise to a decrease in coercive force, which results in a decrease in maximum energy product $(BH)_{max}$.

(2) An increase in coercive force unfavorably gives rise to a decrease in saturation magnetization.

(3) In mixing of two powders having different properties, an improvement in magnetic property appears only in the form of the sum of each properties of the two powders, and no improvement in the properties beyond the sum can be obtained.

(4) The magnetic powder comprising two phases (exchange spring magnet) cannot provide anisotropic characteristics.

SUMMARY OF THE INVENTION

In order to solve the above-described problems, the present invention provides a magnetic powder comprising a mixture of two or more powders including a magnetic powder A (residual magnetic flux density: BrA, coercive force: HcA) and a magnetic powder B (residual magnetic flux density: BrB, coercive force: HcB), the residual magnetic flux densities and the coercive forces having the following relationships: BrA>BrB and HcA<HcB.

Further, the present invention provides a process for producing a mixed powder comprising the above magnetic powders and a process for producing a bonded magnet or a sintered magnet produced from the mixed powder.

When two magnetic powders, i.e., a magnetic powder having high Br and low iHc and a magnetic powder having low Br and high iHc, are mixed together, magnetic interaction works among the mixed powder, so that the resultant magnetic powder has magnetic properties superior to those obtained by merely adding the magnetic properties of the two powders. This greatly contributes to an improvement in squareness, as shown in Example A of FIG. 2. In this case, the magnetic interaction among different magnetic particles, which is indispensable to an improvement in performance, is such that the magnetization reversal of particles having a low coercive force is suppressed by a magnetic field like a kind of mean field formed among particles having a high coercive force.

In order to enhance this interaction, the coercive forces of the magnetic powders to be mixed together are preferred to meet the relationship HcA=y.HcB ($0.1<y<1$). When y is less than 0.1, the suppression of magnetization reversal by the magnetic powder having a high coercive force becomes so weakened that a dent occurs in a demagnetization curve resulting in a lowered squareness. The term "dent" used herein is intended to mean that an inflection point is present in a magnetization curve of the second quadrant (the fourth quadrant). More specifically, a demagnetization curve having a dent is, for example, that for Comparative Example 1—1 shown in FIG. 2.

The magnitude of the residual magnetic flux density (or saturation magnetization) of the magnetic powder is greatly involved in the magnetic interaction. In order to enhance this interaction, it is preferred to meet the relationship BrA=x.BrB ($1x\leqq 2$). When the x is 1 or less, although the squareness in the mixture of two powders is good, total Br of the two powders is decreased, which eventually results in a decrease in magnetic properties. When x exceeds 2, a large dent occurs and, also in this case, the properties are deteriorated.

The magnetic interaction working between different magnetic powders is mot important, and this interaction works most when both the magnetic powders are in contact with each other as closely as possible and homogeneously dispersed in the whole material. In order to enhance the interaction, it is preferred to meet the relationship $i/j=a(i'/j')(0.5\leqq a\leqq 1.5)$. When a is below 0.5 or exceeds 1.5, one of the magnetic powders is present as cluster and is difficult to be homogeneously dispersed, so that no satisfactory magnetic interaction occurs. More preferably, the value should be $0.9\leqq a\leqq 1.1$ because the different magnetic powders can be homogeneously dispersed in each other.

Microscopically observed, it is important that the different magnetic powders are in contact with each other. Therefore the number n: contacting point of both powders is preferably $2(rA+rB)^2<n$ wherein $rA<rB$, and is preferably $2(rA+rB)^2/rB^2<n$ wherein $rA>rB$. When the n value is equal to $2(rA+rB)^2/rA^2$, the about half of the surface of the powder having a larger particle radius occupied with about half of the different powder. When the n value is less than $2(rA+rB)^2/rA^2$, the powder of the same kind are unfavorably clustered.

Since the magnetic interaction is like the mean filed, there is limitation on the distance to which the interaction can reach. Therefore, the shorter the distance between the two powders is, the bigger the magnitude of the interaction. When the mixed powder comprising the two powders is magnetized, the interaction is enhanced with increasing the packing density of magnetic powder. This interaction is particularly enhanced when the packing density of magnetic powder is 50% or more in bonded magnets and 95% or more in sintered magnets.

Further, when $rA<rB$, the R-TM-N(C,H)-based fine powder is aligned on the surface of the powder particles having a higher coercive force, so that the alignment effect can be added to the interaction. Furthermore, an enhancement in packing density of magnetic powder among powder enhances the magnetic interaction. In order to obtain this effect, it is preferred to meet the relationship $0.1\ \mu m\leqq rA\leqq 10\ \mu m$ and $10\ \mu m\leqq 100\ \mu m$. When rA is less than 0.1 $\mu$m, no rotation torque is obtained and, further, the packing density of magnetic powder is also decreased. When rA is larger than 10 $\mu$m, no enough coercive force can be obtained and the magnetic interaction does not work. When rB is less than 10 $\mu$m, the magnetic field formed by the magnetic powder having a higher coercive force is weakened. On the other hand, when rB is larger than 100 $\mu$m, the packing density of magnetic powder becomes so low that the interaction is weakened. In order to further enhance the interaction, it is preferred to meet the relationship $1\ \mu m\leqq rA\leqq 5\ \mu m$ and $20\ \mu m\leqq rB\leqq 30\ \mu m$. In these ranges, the magnetic interaction becomes so strong that high magnetic properties are obtained.

Even though any one of the two magnetic materials has poor temperature characteristics, that of the mixed materials are improved by the interaction.

As specifically described in Example A and other examples, which will be described later, in the mixed powder, the magnetic interaction is enhanced when there is a difference between powder content values at which the maximum value (peak) of the packing density of magnetic powder and the maximum value (peak) of the maximum energy product $(BH)_{max}$ are obtained respectively. In order to enhance the magnetic interaction, the difference between the weight percentage value of any one powder constituting a mixed powder at which the maximum value of the packing density of magnetic powder is obtained and that of the one powder constituting a mixed powder at which the maximum value of the maximum energy product $(BH)_{max}$ is obtained, for example, in terms of wt % of powder A, is preferably not less than 5 wt %. When the value difference is not less than 5 wt %, certain magnetic interaction works between the powders mixed, so that there is no possibility that the squareness deterioration due to a dent in a demagnetization curve.

In the mixing of magnetic powders, two or more powders should be first mixed together to improve the distensibility (degree or mixing) of different powders, so that more effective magnetic interaction is attained.

Further, when milling and mixing of two or more magnetic powders are simultaneously carried out, fresh powder surfaces, which appear by milling, come into contact with one another, which enhances the magnetic interaction.

In the preparation for bonded magnets, magnetization of the mixed powder followed by molding contributes to an improvement in magnetic interaction among particles, which enables the squareness and the orientation to be improved.

In the preparation of sintered magnets, plasma sintering can minimize the deterioration of the powders and enhance the magnetic interaction.

EXAMPLES

Figure 1:
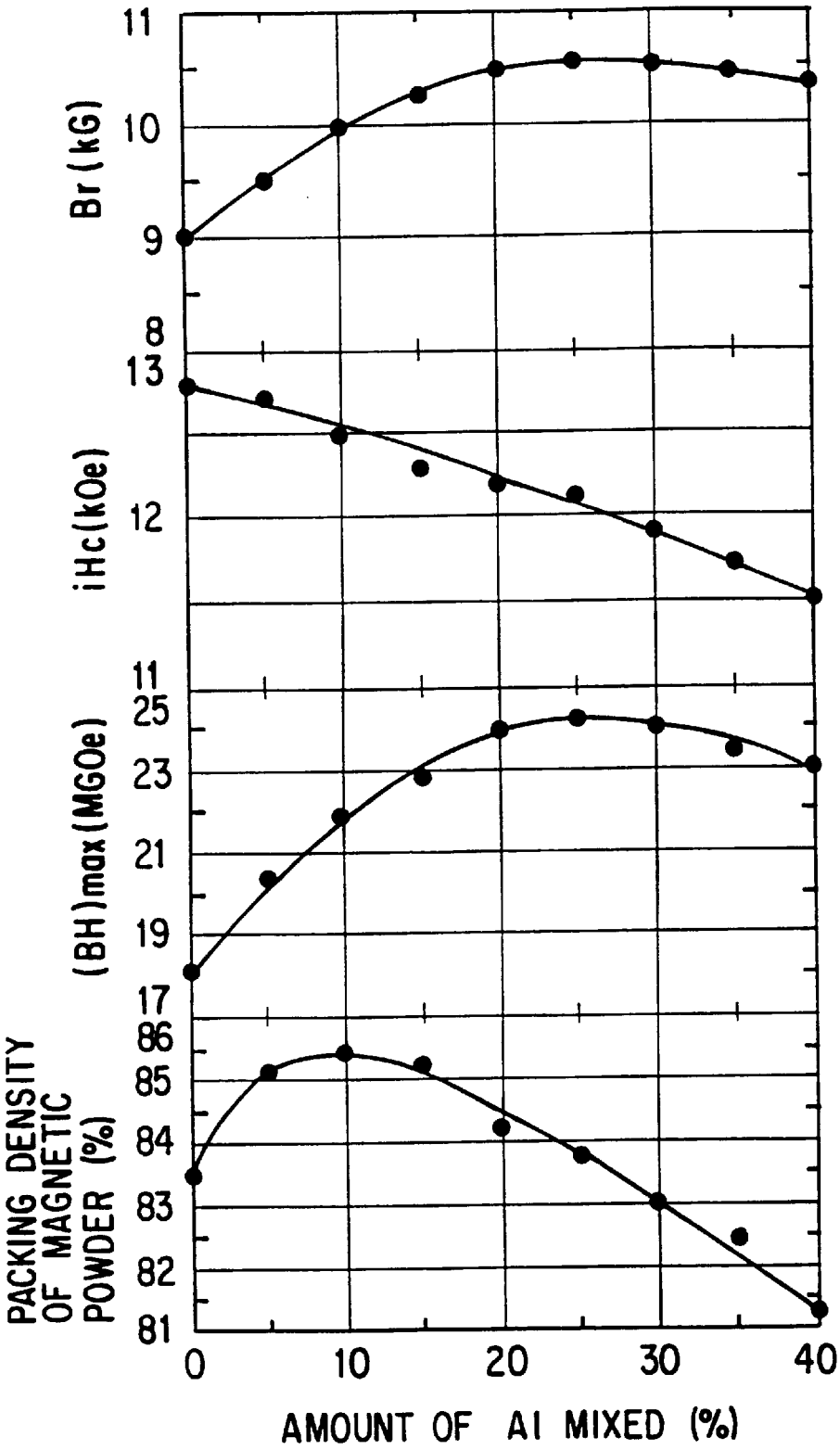
FIG. 1 shows the relationship between the amount of powder A1 and the magnetic properties.

The present invention will now be described in more detail with reference to the following examples.

Example 1

An ingot was prepared by melting and casting using an induction furnace in an argon gas atmosphere in order to be the composition comprising 24.5 wt % Sm and 75.5 wt % Fe. The ingot was subjected to a homogenization treatment at 1100° c. for 24 hrs and coarsely crushed to an average particle diameter of 100 μm by means of stamp mill. The powder was nitrided at 450° C. for one hr in a mixed gas of hydrogen and ammonia. It was then pulverized by means of jet mill to obtain a finely divided powder having an average particle diameter of 2.0 μm. The fine powder was designated as "A1." The coercive force of the fine powder was measured to be 7.9 kOe.

Separately, an ingot was prepared by melting and casting using a high frequency melting furnace in an argon gas atmosphere, resulting in the ingot's composition comprised 24.2 wt % Sm, 45.7 wt % Co, 22.9 wt % Fe, 5.3 wt % Cu and 1.9 wt % Zr. This ingot was subjected to a solution heat treatment in an argon atmosphere at 1150° C. for 24 hrs. Thereafter, the treated ingot was aged in at 800° c. for 12 hrs and then continuously cooled to 400° C. at a rate of 0.5° C./min. Thereafter, the aged ingot was pulverized by means of a stamp mill and an attritor to prepare a powder having an average particle diameter of 21 μm. This powder was designated as "B1." the powder had a coercive force of 12.8 kOe.

The above two powders were mixed together so as to meet the relationship represented by the formula (a)A1+(100-a) B1 wherein a is, in wt %, 0, 5, 10, 15, 20, 25, 30, 35 and 40. The mixed powder was mixed and milled together with 1.6 wt % an epoxy resin, subjected to compression molding in a magnetic field of 15 kOe at a molding pressure of 7 ton/cm$^2$ and then cured in a nitrogen gas atmosphere at 150° C. for one hr to prepare a bonded magnet.

The magnetic properties of a bonded magnets prepared in this example are shown in FIG. 1. In FIG. 1, the peak value of the packing density of magnetic powder is found in a=10 wt %. On the other hand, the peak of the maximum energy product $(BH)_{max}$ is found at a=25 wt %. That is, the a value which provides the peak value of the packing density of magnetic powder is not in agreement with that which provides the peak value of the magnetic property. From this, it is understood that an enhancement in magnetic properties is not attributable to the packing density of magnetic powder alone. The bonded magnet having a=25 wt % will be hereinafter referred to as "Example A."

Then, bonded magnets (resin content: 1.6 wt %) were prepared respectively from powder A1 alone and powder B1 alone. The bonded magnets thus molded were adhered to each other so that the amount of powder A1 was 25 wt % of total body. This composite bonded magnet will be hereinafter referred to as "Comparative Example 1—1."

Figure 2:
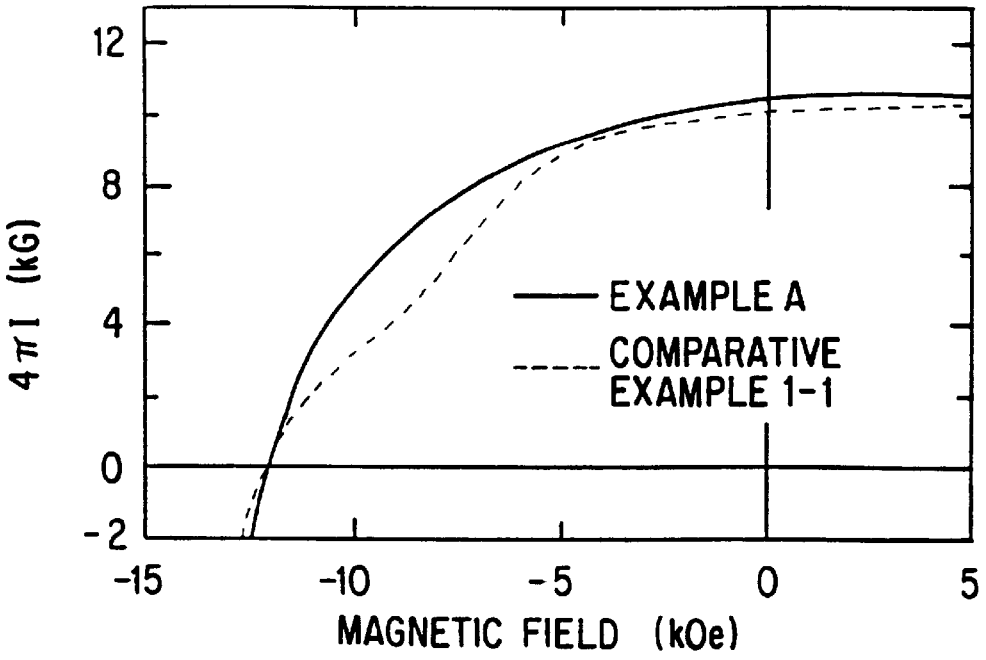
FIG. 2 shows demagnetization curves of mixed bonded magnets (Example A and Comparative Example 1—1)

Magnetization curves (demagnetization curves) for Example A and Comparative Example 1—1 are shown in FIG. 2. If an enhancement in magnetic properties is attributable only to an increase in packing density of magnetic powder alone, both the magnetization curves should be in agreement with each other. However, the magnetization of Example A shows higher value than that of Example B at any magnetic field. This demonstrates that Example A has an improved alignment over the magnet molded by employing a single powder. Further, the magnetization curve for Comparative Example 1—1 has a dent in a region of from 8 to 11 kOe of magnetic field, whereas no dent is observed in the magnetization curve for Example A. This is because in Example A, the magnetic interaction occurred among different particles.

Figure 3:
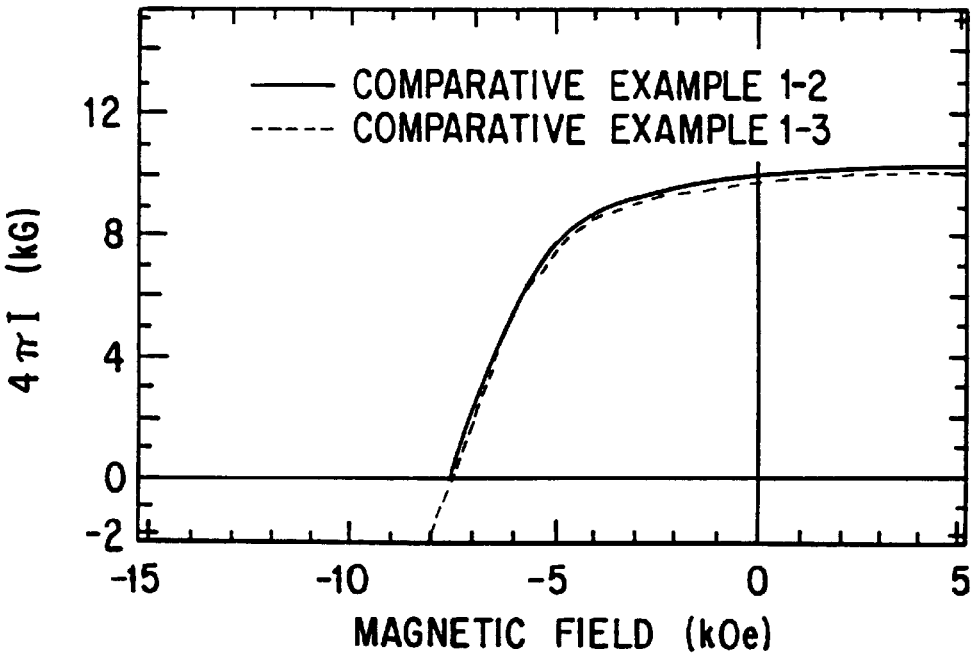
FIG. 3 shows demagnetization curves of mixed bonded magnets (Comparative Example 1–2 and Comparative Example 1–3)

That the magnetic interaction caused by coercive force difference between both powders can be understood from the results obtained in Comparative Examples 1–2 and 1–3. An ingot was prepared by melting and casting using a high frequency melting furnace in an argon gas atmosphere resulting in the ingot's composition comprised 24.2 wt % Sm, 45.7 wt %, Co, 22.9 wt % Fe, 5.3 wt % Cu and 1.9 wt % Zr. This ingot was subjected to a solution heat treatment in an argon atmosphere at 1150° C. for 24 hrs. Thereafter, the treated ingot was then aged at 800° C. for 6 hrs and continuously cooled to 400° C. at a rate of 0.5° C./min. Thereafter, the aged ingot was pulverized by means of a stamp mill and an attritor to prepare a powder having an average particle diameter of 21 $\mu$m. This powder had a coercive force of 7.9 kOe. This powder was mixed with 25 wt % powder A1, and the mixture was further mixed and milled together with 1.6 wt % an epoxy resin. The resultant mixture was subjected to compression molding at a pressure of 7 ton/cm$^2$ in a magnetic field of 15 kOe. The molded body was cured in a nitrogen gas atmosphere at 150° C. for one hr to prepare a bonded magnet. This bonded magnet will be hereinafter referred to as "Comparative Example 1–2. " Separately, bonded magnets were prepared from the respective two powders used in Comparative Example 1–2 and adhered to each other. This composite magnet will be hereinafter referred to as "Comparative Example 1–3." Magnetization curves for both magnets are shown in FIG. 3. As can be seen from FIG. 3, the magnetization curve for Comparative Example 1–2 is substantially in agreement with that for Comparative Example 1–3. From the above results, it can be understood that a high magnetic property by virtue of magnetic interaction cannot be obtained without mixing two magnetic powders different from each other in coercive force.

Example 2

Powder A1 and powder B1 used in Example 1 were mixed together in a weight ratio of 1:3 using a twin-cylinder mixer. The mixture was further mixed and kneaded together with 1.6 wt % of an epoxy resin. The resultant compound was subjected to compression molding at a molding pressure of 7 ton/cm$^2$ in a magnetic field of 15 kOe. The molded body was cured in a nitrogen atmosphere at 150° C. for one hr to prepare a bonded magnet. This bonded magnet will be hereinafter referred to as "Example B."

Then, powder A1 and powder B1 were separately mixed and kneaded together with 1.6 wt % of an epoxy resin. The resultant compounds were again mixed and kneaded together so that the ratio of A1 to B1 was 1:3. The resultant compound was then subjected to compression molding to a pressure of 7 ton/cm$^2$ in a magnetic field of 15 kOe, and the molded body was cured in a nitrogen atmosphere at 150° C. for one hr to prepare a bonded magnet. This bonded magnet will be hereinafter referred to as "Comparative Example 2. " The magnetic properties of Example B and Comparative Example 2 are tabulated below.

| | Br (kG) | iHc (kOe) | (BH)max (MGOe) |
|---|---|---|---|
| Ex. B | 10.5 | 11.9 | 24.6 |
| Comp.Ex. 2 | 9.4 | 11.4 | 18.9 |

Example B had high magnetic property, whereas the properties of Comparative Example 2 were low due to a deteriorating in squareness. Therefore, it can be understood that sufficient mixing of powders followed by molding of a bonded magnet enables strong magnetic interaction to work among different particles, so that a high-performance bonded magnet can be obtained.

Example 3

Cylindrical bonded magnets having a diameter of 10 mm and a height of 7 mm were prepared from Example B, Comparative Example 1–2 and a bonded magnet (Comparative Example 3) comprising powder A1 and, 4 wt % of an epoxy resin. They were subjected to an exposing test at 150° C. for 1000 hrs. The magnetization loss of the cylindrical bonded magnets are tabulated below.

| | Ex. B | Comp.Ex. 1–2 | Comp.Ex. 2 | Comp.Ex. 3 |
|---|---|---|---|---|
| Demagnetization (%) | 4.8 | 10.2 | 7.3 | 46.3 |

It is apparent that Example b is superior in temperature characteristics to the other bonded magnets.

Example 4

An ingot was prepared by melting and casting using an induction furnace in an argon gas atmosphere, resulting in the ingot's composition comprised 24.2 wt % of Sm, 45.7 wt % of Co, 22.9 wt % of Fe, 5.3 wt % of Cu and 1.9 wt % of Zr. This ingot was subjected to a solution heat treatment in an argon atmosphere at 1150° C. for 24 hrs. Thereafter, the treated ingot was then aged at 800° C. for 12 hrs and continuously cooled to 400° C. at a rate of 0.5° C. /min. Thereafter, the aged ingot was coarsely crushed by means of a stamp mill to an average particle diameter of 200 $\mu$m. This powder was designated as "B2."

Powder A1 and powder B2 were mixed in the weight ratio of 1:3. Then pulverization and mixing were simultaneously carried out by means of a ball mill. The mixed powder was mixed and kneaded together with 1.6 wt % of an epoxy resin, subjected to compression molding in a magnetic field of 15 kOe at a pressure of 7 ton/cm$^2$ and cured in a nitrogen atmosphere to 150° C. for one hr to prepare a bonded magnet. This bonded magnet will be hereinafter referred to as "Example C." The magnetic properties of Example C are shown below.

Br=10.9 kG iHc=12.3 kOe $(BH)_{max}$=25.4 MGOe

It is apparent that, by virtue of strong magnetic interaction, Example C has higher magnetic properties than Example A.

Figure 4:
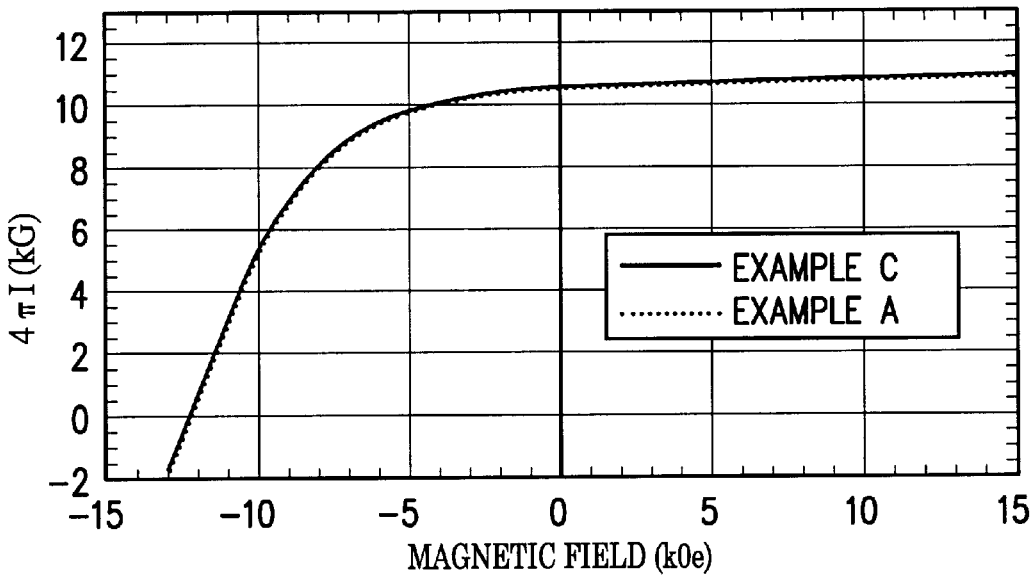
FIG. 4(A) shows demagnetization curves of Examples C and A.
FIG. 4(B) shows a difference in demagnetization curves between Examples C and A.
FIG. 4(C) shows demagnetization curves (Examples C and A) when having been held in air at 150° C. for 100 hrs.
Figure 4:
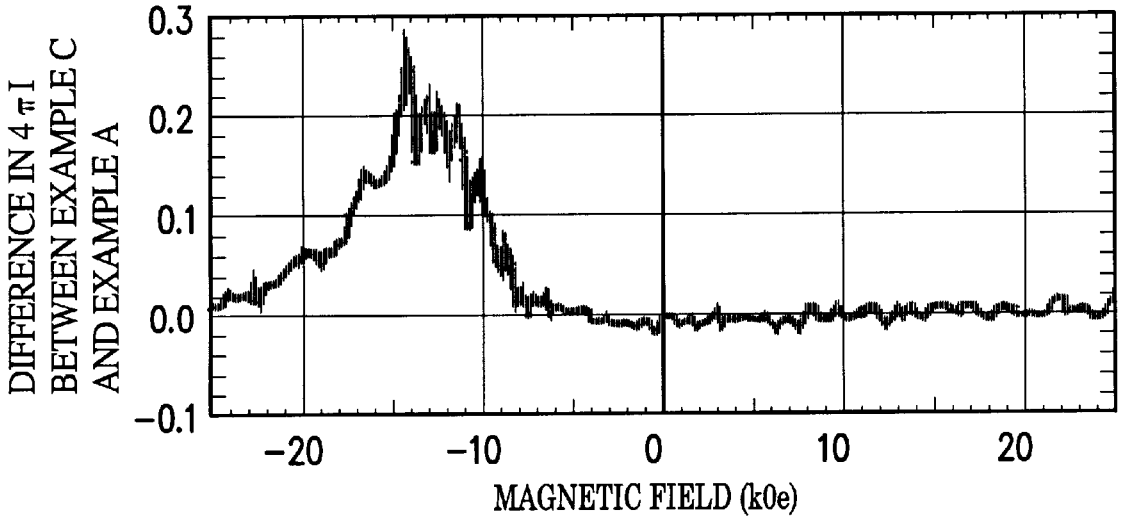
Figure 4:
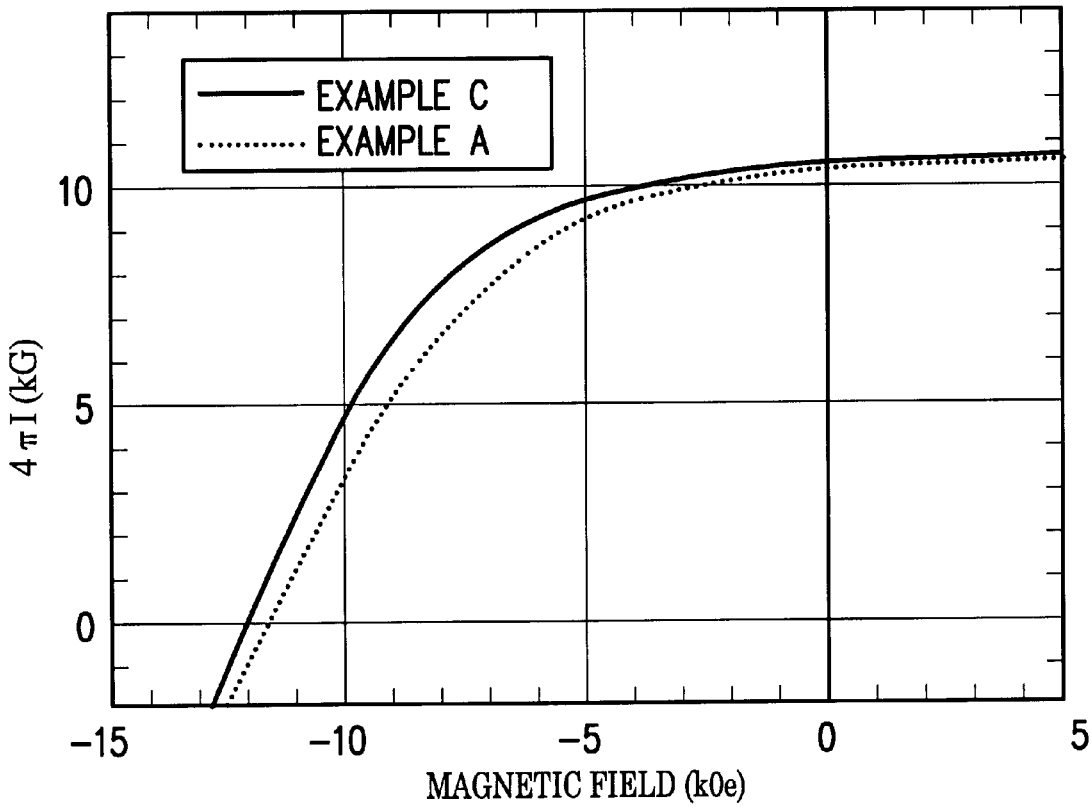

Demagnetization curves for Example C and Example A are shown in FIG. 4(A). Both the demagnetization curves are substantially in agreement with each other. However, when the magnetization difference between both samples curves are strictly observed, FIG. 4(B) is provided, suggesting that an improvement in squareness can be obtained by simultaneous pulverization and mixing. From the above results, it can be understood that simultaneous pulverization and mixing contribute to an improvement in magnetic interaction among particles because fresh surfaces come into contact with one another, so that high magnetic properties can be obtained.

Examples C and Example A were kept in air at 150° C. for 100 hrs. Demagnetization curves for Example c and Example A after the above treatment are shown in FIG. 4(C). From FIG. 4(C), it can be clearly understood that Example C is superior to Example A in temperature characteristics.

Example 5

An ingot was prepared by melting and casting using an induction furnace in an argon gas atmosphere, resulting in the ingot's composition comprised 24.5 wt % of Sm and 75.5 wt % of Fe. The ingot was subjected to a homogenization heat treatment at 1100° C. for 24 hrs and coarsely crushed to an average particle diameter of 100 μm by means of a stamp mill. The powder was nitrided at 450° C. for one hr in a mixed gas of hydrogen and ammonia, It was then pulverized by means of a jet mill. At that time, the coercive force was varied by varying the pulverization time. The resultant powders are collectively referred to as "X."

Separately, an ingot was prepared by melting and casting using an induction furnace in an argon gas atmosphere resulting in the composition comprised 24.2 wt % of Sm, 45.7 wt % of Co, 22.9 wt % of Fe, 5.3 wt % Cu and 1.9 wt % of Zr. This ingot was subjected to a solution heat treatment in an argon atmosphere at 1150° C. for 24 hrs. Thereafter, the treated ingot was aged at 800° C. for 1 to 24 hrs and continuously cooled to 400° C. at a rate of 0.5° C./min. In this case, the coercive force was varied by varying the aging treatment time. Thereafter, pulverization was carried out by means of stamp mill and attritor. The resultant powders are collectively referred to as "Y."

Figure 5:
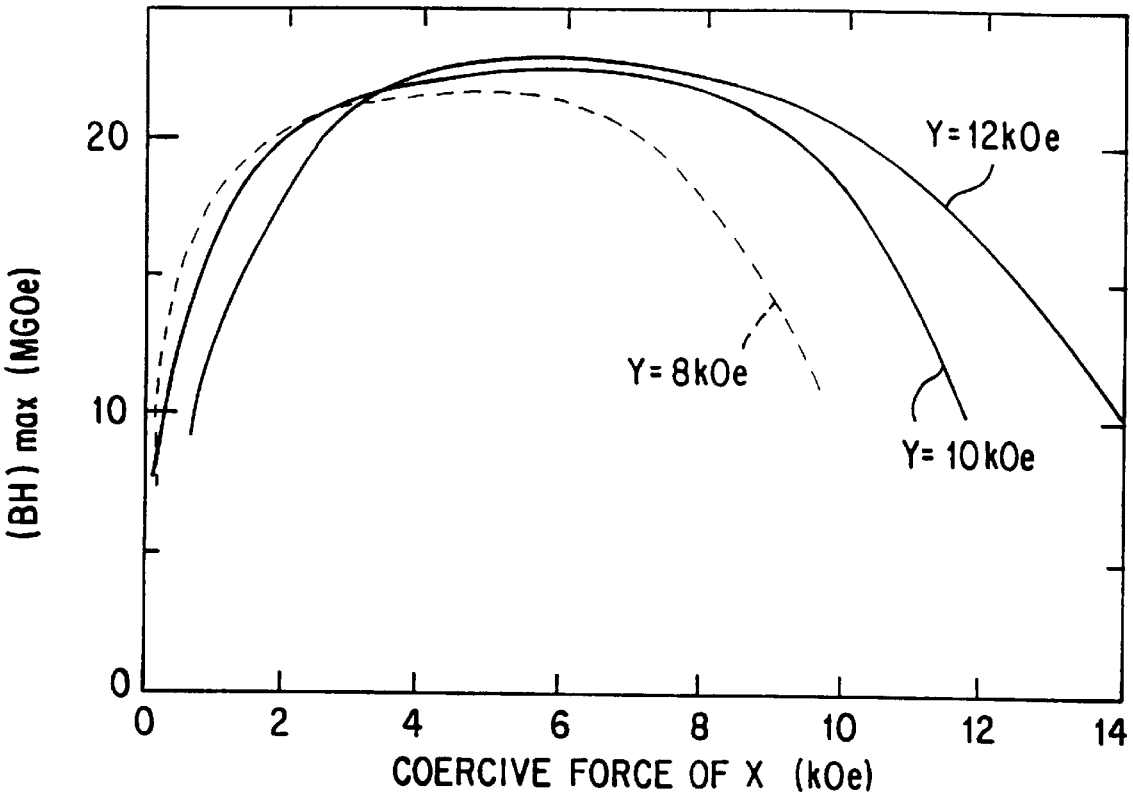
FIG. 5 shows the relationship between the difference in coercive forces between two powders and the maximum energy product.

Powder X and powder Y were mixed together so that the x content was 25 wt %. The mixed powder was mixed and kneaded together with 1.6 wt % of an epoxy resin, and the resultant compound was subjected to compression molding in a magnetic field of 15 kOe at a molding pressure of 7 ton/cm$^2$ and cured in a nitrogen atmosphere at 150° C. for one hr to prepare bonded magnets. The magnetic properties of the bonded magnets were measured, and the results are shown in FIG. 5.

When the coercive force of X is less than (coercive force of Y)/10, it becomes difficult to suppress the reversal of magnetization due to the magnetic powder having a higher coercive force, so that a dent occurs in the demagnetization curve and, at the same time, the squareness is deteriorated. On the other hand, when the coercive force of X exceeds that of Y, no satisfactory rotation torque can be obtained, so that the magnetic properties are deteriorated.

From the above results, it can be understood that in order to enhance the magnetic properties by strong magnetic interaction, it is desirable to satisfy a requirement represented by the relationship (coercive force of Y)/10≦(coercive force of X)≦(coercive force of Y).

This tendency is observed in all the magnetic powders, being independent of mixed powders used.

Example 6

An ingot was prepared by melting and casting using an induction furnace in an argon gas atmosphere, resulting in the composition comprised 24.5 wt % of Sm and 75.5 wt % of Fe. The ingot was subjected to a homogenization heat treatment at 1100° C. for 24 hrs and coarsely crushed to an average particle diameter of 100 μm by means of a stamp mill. The powder was nitrided at 450° C. for one hr in a mixed gas of hydrogen and ammonia. It was then pulverized by means of jet mill. At that time, the average powder particle diameter was varied by varying the pulverization time. The resultant powders are collectively referred to as "X2. " The average particle diameters were shown in Table 1.

Then, an ingot was prepared by melting and casting using an induction furnace in an argon gas atmosphere, resulting in the composition comprised 24.2 wt % of Sm, 45.7 wt % of Co, 22.9 wt % of Fe, 5.3 wt % of Cu and 1.9 wt % of Zr. This ingot was subjected to a solution heat treatment in an argon atmosphere at 1150° C. for 24 hrs. Thereafter, the treated ingot was then aged at 800° C. for 12 hrs and continuously cooled to 400° C. at a rate of 0.5° C./min. Thereafter, pulverization was carried out by means of stamp mill and attritor. The average powder particle diameters shown in Table 1. These powders are collectively referred to as "Y2."

Powder X2 and powder Y2 were mixed together so that the X2 content was 25 wt %. The mixed powder was mixed and kneaded together with 1.6 wt % of an epoxy resin, and the resultant compound was subjected to compression molding in a magnetic field of 15 kOe at a pressure of 7 ton/cm$^2$ and cured in a nitrogen atmosphere at 150° C. for one hr to prepare bonded magnets. The magnetic properties of the bonded magnets were measured, and the results are shown in Table 1.

TABLE 1

| | Particle diameter of X2 (μm) | Particle diameter of Y2 (μm) | (BH)max (MGOe) |
|---|---|---|---|
| Comp.Ex. | 0.03 | 5.1 | 15.1 |
| Comp.Ex. | Do. | 10.3 | 16.4 |
| Comp.Ex. | Do. | 21.0 | 17.1 |
| Comp.Ex. | Do. | 28.6 | 18.1 |
| Comp.Ex. | Do. | 90.2 | 16.9 |
| Comp.Ex. | Do. | 134.5 | 16.0 |
| Comp.Ex. | 0.1 | 5.1 | 18.4 |
| Ex. | Do. | 10.3 | 22.9 |
| Ex. | Do. | 21.0 | 23.2 |
| Ex. | Do. | 28.6 | 23.3 |
| Ex. | Do. | 90.2 | 22.9 |
| Comp.Ex. | Do. | 134.5 | 19.6 |
| Comp.Ex. | 1.2 | 5.1 | 18.6 |
| Ex. | Do. | 10.3 | 23.2 |
| Ex. | Do. | 21.0 | 24.6 |
| Ex. | Do. | 28.6 | 23.8 |
| Ex. | Do. | 90.2 | 22.8 |
| Comp.Ex. | Do. | 134.5 | 19.3 |
| Comp.Ex. | 4.9 | 5.1 | 17.3 |
| Ex. | Do. | 10.3 | 22.7 |
| Ex. | Do. | 21.0 | 23.9 |
| Ex. | Do. | 28.6 | 24.0 |
| Ex. | Do. | 90.2 | 23.6 |
| Comp.Ex. | Do. | 134.5 | 19.5 |
| Comp.Ex. | 9.1 | 5.1 | 17.1 |
| Ex. | Do. | 10.3 | 23.1 |
| Ex. | Do. | 21.0 | 23.3 |
| Ex. | Do. | 28.6 | 23.6 |
| Ex. | Do. | 90.2 | 23.0 |
| Comp.Ex. | Do. | 134.5 | 19.8 |
| Comp.Ex. | 15.1 | 5.1 | 19.1 |
| Comp.Ex. | Do. | 10.3 | 19.1 |
| Comp.Ex. | Do. | 21.0 | 19.3 |
| Comp.Ex. | Do. | 28.6 | 19.6 |
| Comp.Ex. | Do. | 90.2 | 19.3 |
| Comp.Ex. | Do. | 134.5 | 19.0 |

When the particle diameter of powder X2 was less than 0.1 μm, no satisfactory rotation torque was obtained. Further, in this case, the density of magnetic powder was also decreased by a lowering magnetic interaction among particles, which resulted in a deterioration in magnetic properties. When the powder particle diameter of X2 exceeded 10 μm, the coercive force was so low that no magnetic interaction was obtained, which results in a deterioration in magnetic property. On the other hand, when the powder particle diameter of Y2 was less than 10 μm, the magnetic property was deteriorated due to a reduction in influence of the magnetic field on X2, while when the powder particle diameter exceeded 100 μm, the magnetic properties were deteriorated due to lowered packing density of magnetic powder and a lowered magnetic interaction. From the above results, in order to enhance the magnetic property, it is desirable to meet the relationship: 0.1 μm≦(powder particle diameter of X2)≦10 μm and 10 μm≦(powder particle diameter of Y2)≦100 μm. Further, when the relation 1 μm≦(coercive force of Y)≦30 μm are met, particularly strong magnetic interaction occurs, so that a very high magnetic property can be obtained.

Example 7

Magnetic powder A1 obtained and magnetic powder B1 were mixed so that powder A1 content was 25 wt %. At that time, the mixing time was varied to vary the degree of dispersion between different powders. The degree of dispersion was roughly estimated in terms of the value a defined in claim 4 of the present application. Since the total amount of the mixed powder was 100 g, 1 g of the mixed power was randomly sampled therefrom. The mixing ratio of A1 to B1 was measured from the 1 g sample to determine the value a. The results are shown in FIG. 6.

Figure 6:
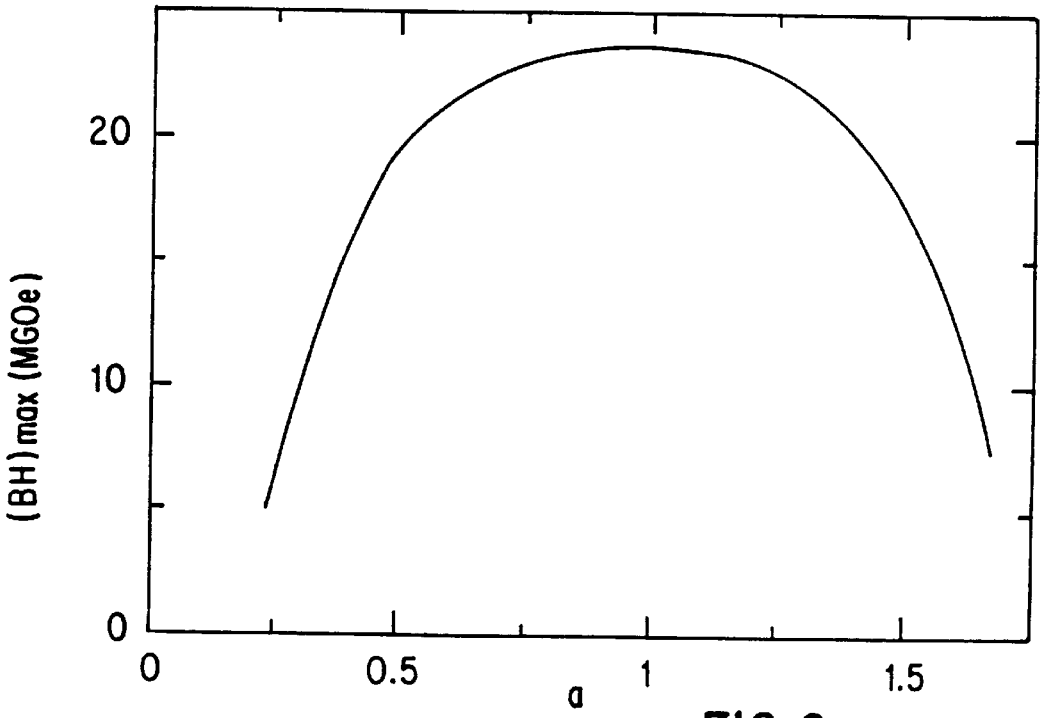
FIG. 6 shows the relationship between the coefficient of dispersion of powder and the maximum energy product.

From FIG. 6, it is apparent that when 0.5≦a≦1.5, the maximum energy product $(BH)_{max}$ was high, whereas when the value a was outside this range, $(BH)_{max}$ was rapidly lowered. This suggests that the dispersion of different powders contributes to an improvement in magnetic interaction, which results in an improvement in magnetic property. The value a is still preferably 0.9≦a≦1.1 because a particularly high $(BH)_{max}$ can be obtained.

Example 8

Melting and casting were carried out using an induction furnace in an argon gas atmosphere, resulting in the composition comprised 12.4 wt % of Nd, 65.9 wt % of Fe, 15.9 wt % of Co and 5.8 wt % of B. A rapidly quenched ribbon was prepared using a single roll. Then the ribbon was crushed and placed in a mold, subjected to high-temperature of 700 to 800° C. for a short period of time at 2 ton/cm$^2$ and further subjected to high-temperature compression molding in the vertical direction to the initial compressing direction. Next the compressed body was pulverized. The resultant powder was designated as "B3."

Magnetic properties were measured in the same manner as in Example 1 with various mixing ratios. As a result, the peak value of the packing density of magnetic powder was obtained at a=15 wt %. On the other hand, the peak value of $(BH)_{max}$ was obtained at a=30 wt %. The bonded magnet having a=30 wt % will be hereinafter referred to as "Example D." The magnetic properties of Example D were as follows. The properties of a bonded magnet as Comparative Example 4 prepared by using powder B3 along are also given below.

| | Br (kG) | iHc (kOe) | (BH)max (MGOe) |
|---|---|---|---|
| Ex. D | 10.2 | 12.5 | 21.2 |
| Comp.Ex. 4 | 9.1 | 14.1 | 17.4 |

It can be understood that as compared with Comparative Example 4, Example D had very high magnetic properties by virtue of magnetic interaction.

Example 9

An ingot was prepared by melting and casting using an induction furnace in an argon gas atmosphere, resulting in the composition comprised 6.7 wt % of Sm, 2.3 wt % of Ce, 6.8 wt % of Pr, 6.9 wt % of Nd, 51.2 wt % of Co, 15.39 wt % of Fe, 6.8 wt % of Cu and 3.4 wt % of Zr. This ingot was subjected to a solution heat treatment in an argon atmosphere at 1145° C. for 24 hrs. Thereafter, the treated ingot was then aged at 780° C. for 12 hrs and continuously cooled to 400' C. at a rate of 0.5° C./min. Thereafter, the aged ingot was pulverized by means of stamp mill and attritor to prepare a powder having an average particle diameter of 20 μm. This powder was designated as "B6." The powder had a coercive force of 10.5 kOe.

Then, an input was prepared by melting and casting using an induction furnace in an argon gas atmosphere, resulting in the composition comprised 22.5 wt % of Sm, 2.3 wt % of Pr, 70.1 wt % of Fe and 5.1 wt % of Co. The ingot was subjected to a homogenization heat treatment at 1100° C. for 24 hrs and coarsely crushed to an average particle diameter of 100 μm by means of stamp mill. The powder was nitrided at 450° C. for 2 hrs in an mixed gas of hydrogen and ammonia. It was then pulverized by means of jet mill to prepare a fine powder having an average particle diameter of 2.2 μm. The fine powder was designated as "A4." The coercive force of this powder was measured to be 6.5 kOe.

Powder A4 and powder B6 were mixed and kneaded together in a weight ratio of A4 and B6 of 1:3. The resultant compound was subjected to compression molding in a magnetic field of 15 kOe at a pressure of 7 ton/cm$^2$ and cured in a nitrogen atmosphere at 150° C. for one hr to prepare a bonded magnet. This bonded magnet will be hereinafter referred to as "Example E." The magnetic properties of Example E are shown below.

Br=10.2 kG iHc=9.1 kOe $(BH)_{max}$=23.5 MGOe

Despite the fact that the Sm content of Example E was lower than that of Example A, Example E exhibited sufficiently high magnetic properties.

Example 10

Powder A1 and powder B1 used in Example 1 were mixed together in a weight ratio of 1:3. The mixture was further mixed and kneaded together with 1.6 wt % of an epoxy resin. The resultant compound was magnetized in a magnetic field of 40 kOe, subjected to compression molding at a pressure of 7 ton/cm$^2$ in a magnetic field of 15 kOe. The molding was cured in a nitrogen gas atmosphere at 150° C. for one hr to prepare a bonded magnet. This bonded magnet will be hereinafter referred to as "Example F." The magnetic properties of Example F are shown below.

Br=10.9 kG iHc=12.1 kOe $(BH)_{max}$=25.6 MGOe

Thus, magnetizing in a powder (compound) form has enabled Example F to have an enhanced Br value over Example A.

Example 11

An alloy comprising, 10.5 wt % Sm and 89.5 wt % Fe, which had been prepared by using Sm having a purity of 99.9% and Fe having a purity of 99.9%, was prepared using an induction furnace in an Ar atmosphere. The resultant ingot was then subjected to a homogenization heat treatment in an Ar atmosphere at 1100° C. for 24 hrs. Thereafter, the ingot was coarsely crushed to a powder particle diameter of about 100 μm and then carbonized in an acetylene gas at 250° C. for one hr. The resultant powder was pulverized to an average particle diameter of 5 μm. This powder was designated as "A3."

20 wt % of powder A3 was added to powder B1, and pulverization and mixing were simultaneously carried out in a ball mill. The mixed powder was mixed and milled together with a 1.6 wt % of an epoxy resin. The resultant compound was then subjected to compression molding at a pressure of 7 ton/cm$^2$ in a magnetic field of 15 kOe and cured in a nitrogen atmosphere at 150° C. for one hr to prepare a bonded magnet. The magnetic properties of this bonded magnet are shown below.

Br=10.2 kG iHc=10.1 kOe $(BH)_{max}$=22.4 MGOe

As is apparent from the above results, sufficiently high magnetic properties can be obtained also in a carbide system other than $R_2Fe_{17}N_x$ system. Therefore, it can be understood that an enhancement in magnetic properties by taking advantage of magnetic interaction according to the present invention is not limited to a system having a particular composition.

Example 12

An ingot was prepared by melting and casting using an induction furnace in an argon gas atmosphere, resulting in the composition comprises 24.2 wt % of Sm, 45.7 wt % of Co, 22.9 wt % of Fe, 5.3 wt % of Cu and 1.9 wt % of Zr. This ingot was subjected to a solution heat treatment in an argon atmosphere at 1150° C. for 24 hrs. Thereafter, the treated ingot was then aged at 800° C. for 12 hrs and continuously cooled at 400° C. at a rate of 0.5° C./min. Thereafter, the aged ingot was pulverized by means of stamp mill and attritor to prepare a powder having an average particle diameter of 21 μm. This powder was designated as "A2." Powder A2 was mixed and milled together with 1.6 wt % of an epoxy resin, subjected to compression molding in a magnetic field of 15 kOe at a pressure of 7 ton/cm$^2$ and cured at 150° C. for one hr to prepare a bonded magnet. This bonded magnet was designated as "Comparative Example 5."

Separately, an ingot was prepared by melting and casting, resulting in the composition comprised 25.8 wt % of Sm, 44.9 wt % of Co, 24.8 wt % of Fe, 3.2 wt % of Cu and 1.3 wt % of Zr. The ingot was then subjected to a solution heat treatment in an argon atmosphere at 1120° C. for 48 hrs. Thereafter, the treated ingot was then aged at 800° C. for 15 hrs and continuously cooled to 400° C. at a rate of 0.5° C./min. Thereafter, the aged ingot was pulverized by means of stamp mill and attritor to prepare a powder having an average particle diameter of 23 μm. This powder was designated at "B4." Powder B4 was mixed and kneaded together with 1.6 wt % of an epoxy resin, subjected to compression molding in a magnetic field of 15 kOe at a pressure of 7 ton/cm$^2$ and cured at 150+ C. for one hr to prepare a bonded magnet. This bonded magnet was designated as "Comparative Example 6."

Figure 7:
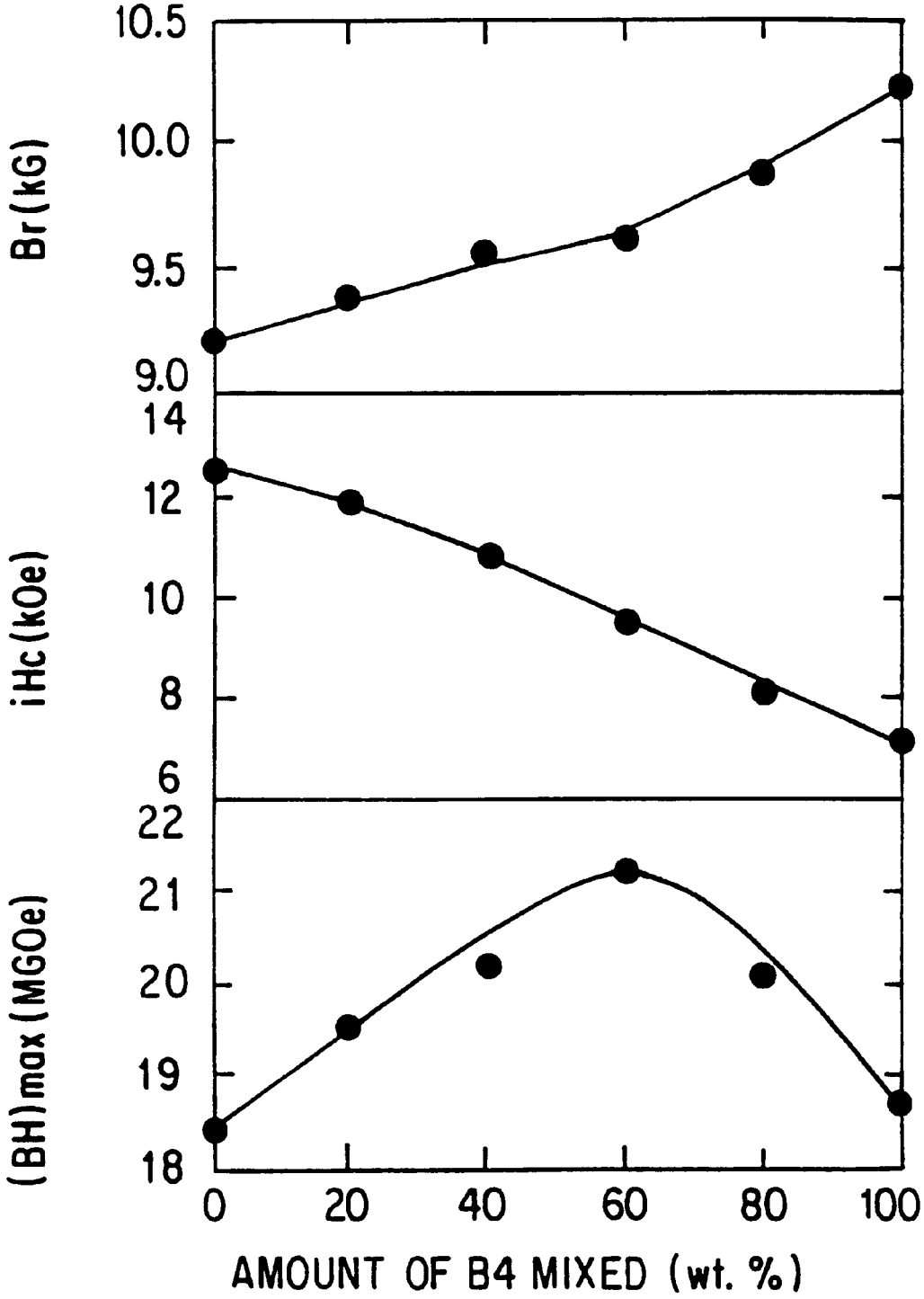
FIG. 7 shows the relationship between the amount of powder B4 mixed and the magnetic properties.

The above two powders were mixed together so as to meet the relationship {(a)xA2}+{(100−a)B4} wherein a is, in wt %, 0 (Comparative Example 6), 20, 40, 60, 80 and 100 (Comparative Example 5). the mixed powder was mixed and kneaded together with 1.6 wt % of an epoxy resin, subjected to compression molding in a magnetic field of 15 kOe at a pressure of 7 ton/cm$^2$ and cured at 150° C. for one hr to prepare a bonded magnet. The magnetic properties of the bonded magnet are shown in FIG. 7. As is apparent from FIG. 7, the maximum energy product had a peak value when the value a was 40 wt %. This bonded magnet having a value a of 40% and a higher performance than a bonded magnet either comprising A1 alone or a bonded magnet comprising B1 alone. The bonded magnet having a value a of 40 wt %will be hereinafter referred to as "Example G." The magnetic properties of Example G, Comparative Example 5 and Comparative Example 6 were as follows.

| | Br (kG) | iHc (kOe) | (BH)max (MGOe) |
|---|---|---|---|
| Ex. G | 9.6 | 9.5 | 21.2 |
| Comp.Ex. 5 | 9.2 | 12.5 | 18.5 |
| Comp.Ex. 6 | 10.2 | 7.2 | 18.8 |

Figure 8:
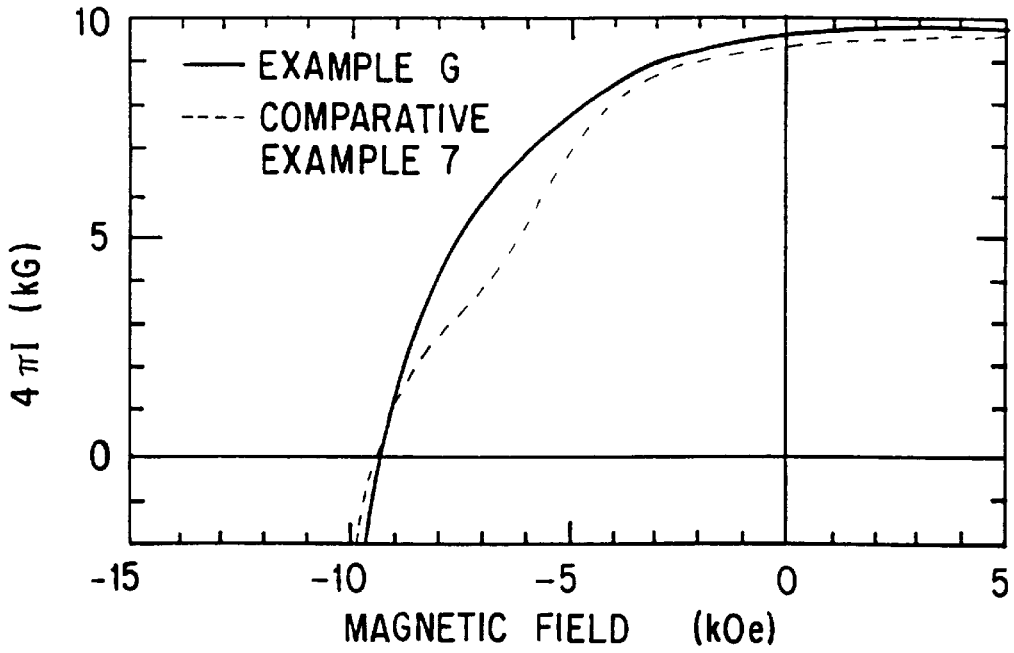
FIG. 8 shows demagnetization curves of mixed bonded magnets (Example G and Comparative Example 7)

Then, the bonded magnets were prepared respectively from powder A2 alone and powder B4 alone. The two bonded magnets thus formed were adhered to each other so that the amount of powder A2 and 40 wt %. This composite bonded magnet will be hereinafter referred to as "Comparative Example 7." Magnetization curves (demagnetization curves) for Example G and Comparative Example 7 are shown in FIG. 8. The magnetization curve for Comparative Example 7 had a dent in the region of from 5 to 9 kOe, whereas no dent was observed in the magnetization curve for Example G. This is because, in Example G, magnetic interaction occurred among different particles. The term "dent" used herein is intended to mean that an inflection point is present in a magnetization curve of the second quadrant (the fourth quadrant).

Example 13

An ingot was prepared by melting and casting using an induction furnace in an argon gas atmosphere, resulting in the composition comprises 10.0 wt % of Sm, 14.0 wt % of Pr, 46.3 wt % of Co, 21.6 wt % of Fe, 6.2 wt % of Cu and 1.9 wt % of Zr. This ingot was subjected to a solution heat treatment in an argon atmosphere at 1130° C. for 48 hrs. Thereafter, the treated ingot was then aged at 800° C. for 12 hrs and continuously cooled to 400° C. at a rate of 0.5° C./min. Thereafter, the aged ingot was pulverized by means of stamp mill and attritor to prepare a powder having an average particle diameter of 20 μm. This powder was designated at "C1." Powder C1 was mixed and milled together with 1.6 wt % of an epoxy resin, subjected to compression molding in a magnetic field of 15 kOe at a pressure of 7 ton/cm$^2$ and cured at 150° C. for one hr to prepare a bonded magnet. This bonded magnet was designated as "Comparative Example 7."

Powder C1 and Powder A2 were mixed together in a weight ratio of 13:7, and the mixed powder was further mixed and kneaded together with 1.6 wt % of an epoxy resin, subjected to compression molding in a magnetic field of 15 kOe at a pressure of 7 ton/cm$^2$ and cured at 150° C. for one hr to prepare a bonded magnet. This bonded magnet will be hereinafter referred to as "Example H." The above procedure was repeated to prepare a bonded magnet, except that in the case of the magnets in which powder C1 alone was used. This bonded magnet will be hereinafter referred to as "Comparative Example 8." The magnetic properties of Example H and Comparative Example 8 are tabulated below.

| | Br (kG) | iHc (kOe) | (BH)max (MGOe) |
|---|---|---|---|
| Comp.Ex. 7 | 9.1 | 11.5 | 19.2 |
| Ex. H | 9.8 | 10.8 | 22.1 |
| Comp.Ex. 8 | 10.5 | 7.1 | 17.8 |

As is apparent from the above results, Example H had high magnetic properties, whereas Comparative Example 8 has a deteriorated performance due to a low coercive force.

Example 14

An ingot as prepared by melting and casting using an induction furnace in an argon gas atmosphere, resulting in the composition comprised 12.4 wt % of Sm, 11.9 wt % of Nd, 46.2 wt % of Co, 21.5 wt % of Fe, 6. wt % of Cu and 1.9 wt % of Zr. This ingot was subjected to a solution heat treatment in an argon atmosphere at 1140° C. for 48 hrs. Thereafter, the treated ingot was then aged at 800° C. for 12 hrs and continuously cooled to 400° C. at a rate of 0.5° C./min. Thereafter, the aged ingot was pulverized by means of stamp mill and attritor to prepare a powder having an average particle diameter of 22 $\mu$m. This powder was designated at "D1."Powder D1 was mixed and kneaded together with 1.6 wt % of an epoxy resin, subjected to compression molding in a magnetic field of 15 kOe at a pressure of 7 ton/cm$^2$ and cured at 150° C. for one hr to prepare a bonded magnet. This bonded magnet was designated as "Comparative Example 9."

Powder D1 and powder A2 were mixed together in a weight ration of 60:40, and the mixture was further mixed and kneaded together with 1.6 wt % of an epoxy resin, subjected to compression molding in a magnetic field of 15 kOe at a molding pressure of 7 ton/cm$^2$ and cured at 150° C. for one hr to prepare a bonded magnet. This bonded magnet will be hereinafter referred to as "Example I." The above procedure was repeated to prepare a bonded magnet, except that powder C1 alone was used. This bonded magnet will be hereinafter referred to as "Comparative Example 10." The magnetic properties of Example I and Comparative Example 10 are tabulated below.

| | Br (kG) | iHc (kOe) | (BH)max (MGOe) |
|---|---|---|---|
| Comp.Ex. 9 | 9.3 | 10.6 | 19.6 |
| Ex. I | 10.1 | 9.8 | 21.1 |
| Comp.Ex. 10 | 10.9 | 6.7 | 17.3 |

Example I has high magnetic properties, whereas Comparative Example 10 had no satisfactory performance due to a low coercive force.

Example 15

Figure 9:
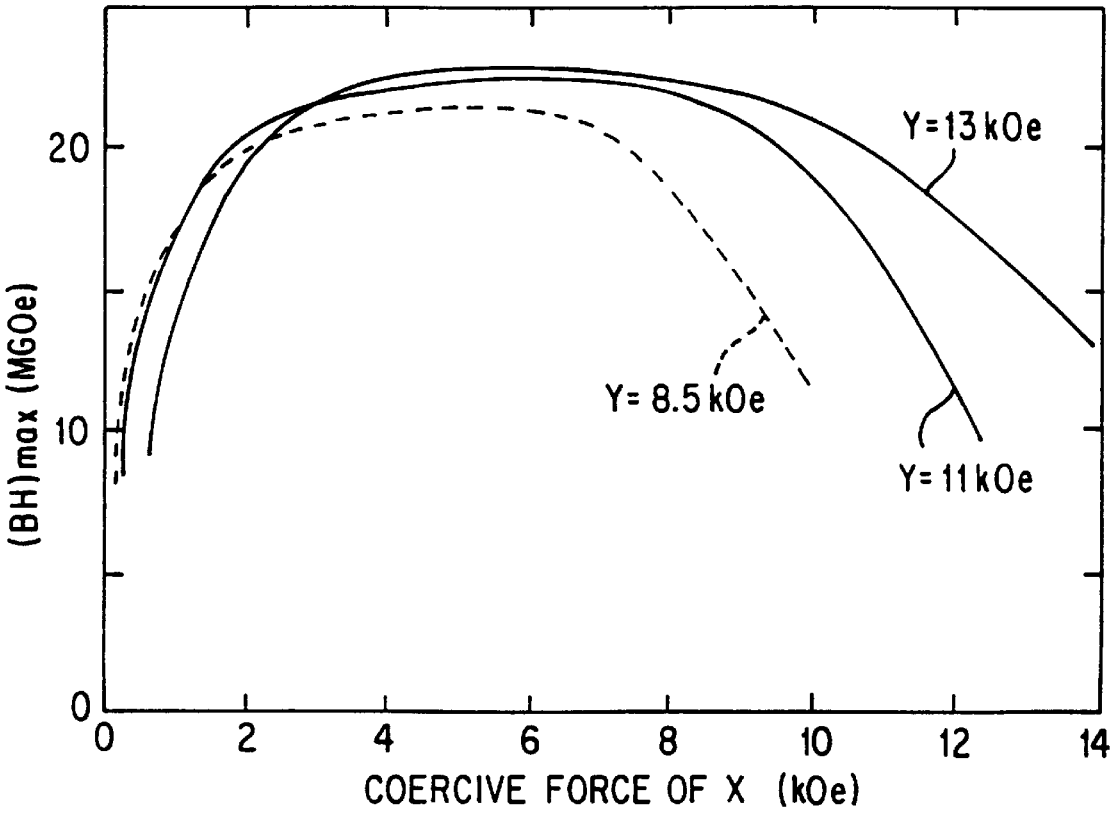
FIG. 9 shows the relationship between the difference in coercive force between two powders and the maximum energy product.

An ingot was prepared by melting and casting using an induction furnace in an argon gas atmosphere in such a manner that the composition comprised 24.2 wt % of Sm, 44.9 wt % of Co, 26.5 wt % of Fe, 3.2 wt % of Cu and 1.2 wt % of Zr. The ingot was subjected to a solution heat treatment in an argon atmosphere at 1120° C. for 48 hrs. Thereafter, the treated ingot was then aged at 800° C. for a given period of time and then continuously cooled to 400° C. at a rate of 0.5° C./min. The coercive force was varied by varying the aging time (1–24 hrs). these powders were designated as "X2." Separately, an ingot was prepared by melting and casting resulting in the composition comprised 24.2 wt % of Sm, 45.7 wt % of Co, 22.9 wt % of Fe, 5.3 wt % of Cu and 1.9 wt % of Zr. The ingot was subjected to a solution heat treatment in an argon atmosphere at 1150° C. for 24 hrs. Thereafter, the treated ingot was then aged at 800° C. for a given period of time (1–16 hrs) and continuously cooled to 400° C. at a rate 0.5° C./min. Thus, powders Y2 having different coercive force were obtained. Thereafter, the above powders were pulverized by means of a stamp mill and an attritor to an average particle diameter of about 20 $\mu$m. Powders X2 and powders Y2 were mixed together in a mixing ratio of 3:2. 1.6 wt % of an epoxy resin was added to the mixed powders, and they were mixed and kneaded together. The resultant compounds were subjected to compression molding in a magnetic field of 15 kOe at a pressure of 7 ton/cm$^2$ and cured at 150° C. for one hr to prepare bonded magnets. The relationship between the coercive force and the obtained $(BH)_{max}$ is shown in FIG. 9.

It is apparent that the $(BH)_{max}$ could be enhanced when the coercive force of X was not less than (coercive force of Y)/10 to not more than the coercive force of Y.

Example 16

Ingots used for the preparation of powders A2, B4, C1 and D1 were designated respectively as A3, B5, C2 and D2. These ingots were coarsely crushed to an average particle diameter of about 200 $\mu$m. The powders prepared by coarse crushing were mixed according to the following formulations.

AB2 . . . A3:B5=2:3

AC2 . . . AC:C2=7:13

AD2 . . . A3:D2=2:3

Mixing the powders were carried out while pulverizing in a ball mill. The mixed powders were mixed and milled together with 1.6 wt % of an epoxy resin, and the resultant compounds were subjected to compression molding in a magnetic field of 15 kOe at a pressure of 7 ton/cm$^2$. The molding were cured at 150° C. for one hr to prepare bonded magnets. These bonded magnets will be hereinafter referred to respectively as "Example J (AB2)," Example K (AC2)," and "Example L (AD2)." The magnetic properties of these bonded magnets are tabulated below.

| | Br (kG) | iHc (kOe) | (BH)max (MGOe) |
|---|---|---|---|
| Ex. J | 10.2 | 9.7 | 22.4 |
| Ex. K | 10.7 | 11.0 | 23.5 |
| Comp.Ex. 12 | 11.0 | 10.1 | 22.7 |

By virtue of strong magnetic interaction, Example J, K and L show higher magnetic properties than Examples G, H and I. This demonstrates that simultaneous pulverization and mixing of powders enhance magnetic interaction among particles (by virtue of contact of fresh surfaces) to provide high magnetic properties.

Example 17

The compounds prepared in Example 16 were magnetized in a magnetic field of 40 kOe, subjected to compression molding in a magnetic field of 15 kOe at a pressure 7 ton/cm$^2$ and cured at 150° C. for one hr to prepare bonded magnets. These bonded magnets were designated as "Example M," "Example N," and "Example ).." The magnetic properties thereof are tabulated below.

| | Br (kG) | iHc (kOe) | (BH)max (MGOe) |
|---|---|---|---|
| Ex. M | 10.6 | 10.2 | 23.4 |
| Ex. N | 11.2 | 11.5 | 24.1 |
| Comp.Ex. 15 | 11.2 | 10.7 | 23.0 |

As is apparent from the above results, by virtue of the magnetization in a powder, Examples M, N and O shown a higher performance than Examples J, K and L.

Example 18

Figure 10:
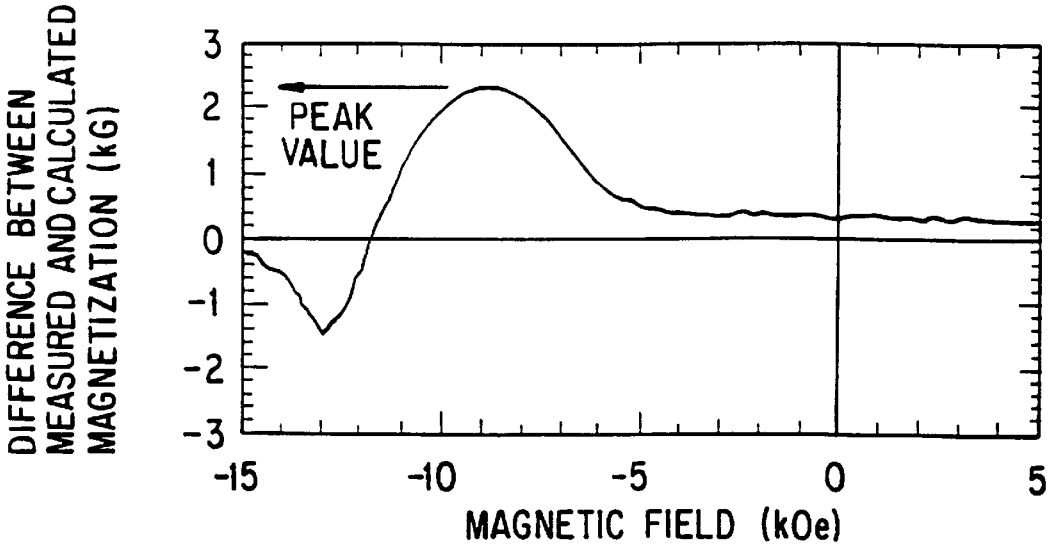
FIG. 10 shows the relationship between the difference between measured and calculated magnetization values and the magnetic field.

Powder A1 and powder B1 were mixed together and pulverized in a weight ratio of 1:3. the mixed powder was mixed and kneaded together with 1.6 wt % of an epoxy resin. The resultant compound was molded in a magnetic field of 15 kOe. At that time, the density of magnetic powder was varied by varying the molding pressure. The magnitude of the magnetic interaction was evaluated in terms of the magnitude of a peak value of a magnetization difference between a demagnetization curve measured in reality magnetization and a demagnetization curve determined by calculation without the interaction. That the calculated magnetization curve is well in agreement with the curve measured in reality demagnetization curve without magnetic interaction has already been illustrated in Example 1. A typical variation in the differences between the measured values and the calculated values is shown in FIG. 10.

Figure 11:
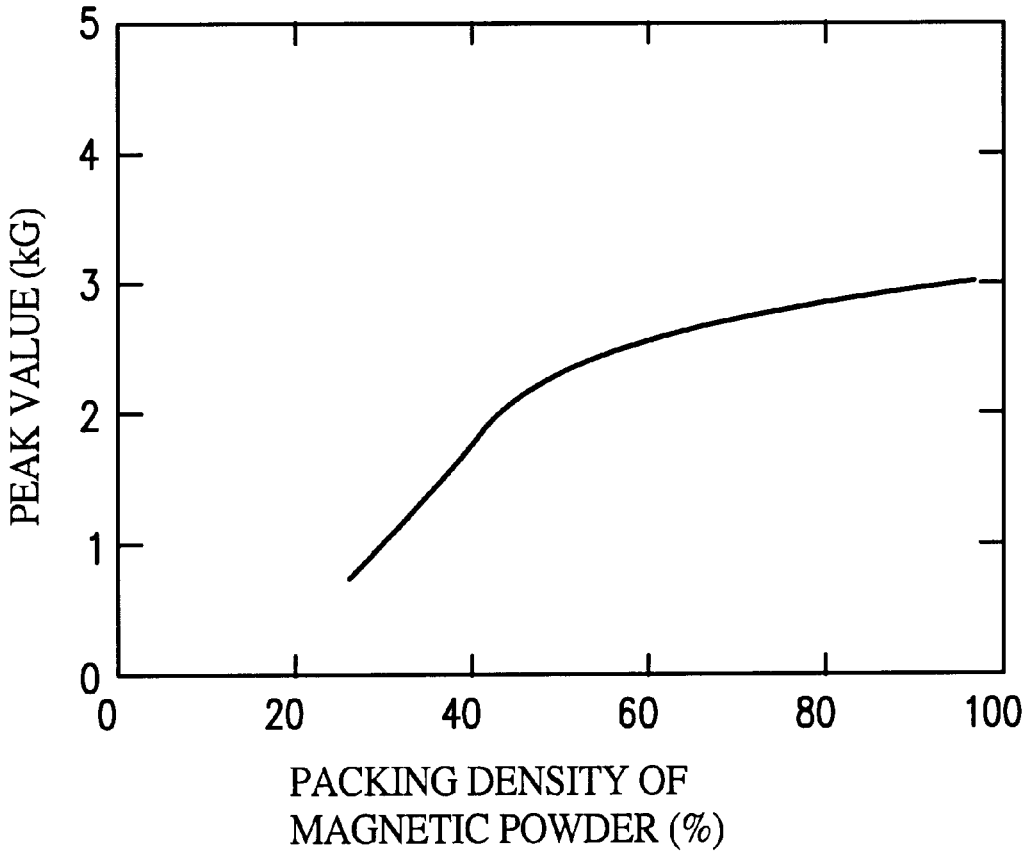
FIG. 11 shows the relationship between the peak value of the difference between measured and calculated magnetization for bonded magnets and the magnetic powder volume packing fraction.

The relationship between the packing density of magnetic powder and the peak value is shown in FIG. 11. As is apparent from the drawing, it can be understood that the peak value increases with increasing the packing density of magnetic powder, which contributes to an improvement in squareness. In particular, the peak value rapidly decreases when the packing density of magnetic powder is not more than 50%, suggesting that the packing density of magnetic powder is critical to effective magnetic interaction.

Example 19

Powder A1 and powder B1 were mixed together and pulverized together in a weight ratio of 1:3 to prepare a mixed powder. The mixed powder was pressed at a pressure of 5 ton/cm$^2$, a pulse current of 200 A was allowed to flow, and plasma sintering was carried out at a sintering temperature of 400° C. for 5 min. The resultant sintered magnet was designated as "Example P." Separately, powder A1 and powder B1 were subjected to plasma sintering in such a manner that two layers were formed in the same composition as in Example P (i.e., so as to prepare a kind of a gradient material). The resultant magnet was designated as "Comparative Example 11."

The magnetic properties of these bonded magnets were as follows.

| | Br (kG) | iHc (kOe) | (BH)max (MGOe) |
|---|---|---|---|
| Ex. P | 12.7 | 10.2 | 37.5 |
| Comp.Ex. 11 | 12.0 | 11.0 | 29.1 |

Comparative Example 11 exhibited lowered magnetic properties due to occurrence of a dent, whereas Example P showed a very good squareness, which contributed to an enhancement in magnetic properties.

Example 20

An ingot was prepared by melting and casting using an induction furnace in an argon gas atmosphere, resulting in the composition comprised 24.2 wt % of Sm, 45.7 wt % of Co, 22.9 wt % of Fe, 5.3 wt % of Cu and 1.9 wt % of Zr. This ingot was subjected to a solution heat treatment in an argon atmosphere at 1150° C. for 12 hrs. This treated ingot was designated as "K1."

Then, an ingot was prepared by melting and casting, resulting in the composition comprised 10.0 wt % of Sm, 14.0 wt % of Pr, 46.3 wt % of Co, 21.6 wt % of Fe, 6.2 wt % of Cu and 1.9 wt % of Zr. This ingot was subjected to a solution heat treatment in an argon atmosphere at 1130° C. for 24 hrs. This treated ingot was designated as "K2."

Ingots K1 and K2 were milled together in a weight ratio of 12:7, by means of jet mill (so that pulverization and mixing were simultaneously carried out). The mixed powder was molded in a magnetic field of 15 kOe, and the resultant molded body was sintered at 1200° C. Thereafter, the sinter body was subjected to a solution heat treatment at 1130° C. for 24 hrs and aged at 800° C. for 12 hrs and then continuously cooled at 400° C. at a rate of 0.5° C./min. The sintered magnet thus prepared had the following performance.

Br=12.1 kG iHc=11.5 kOe (BH)max=38.1 MGOe

Example 21

Figure 12:
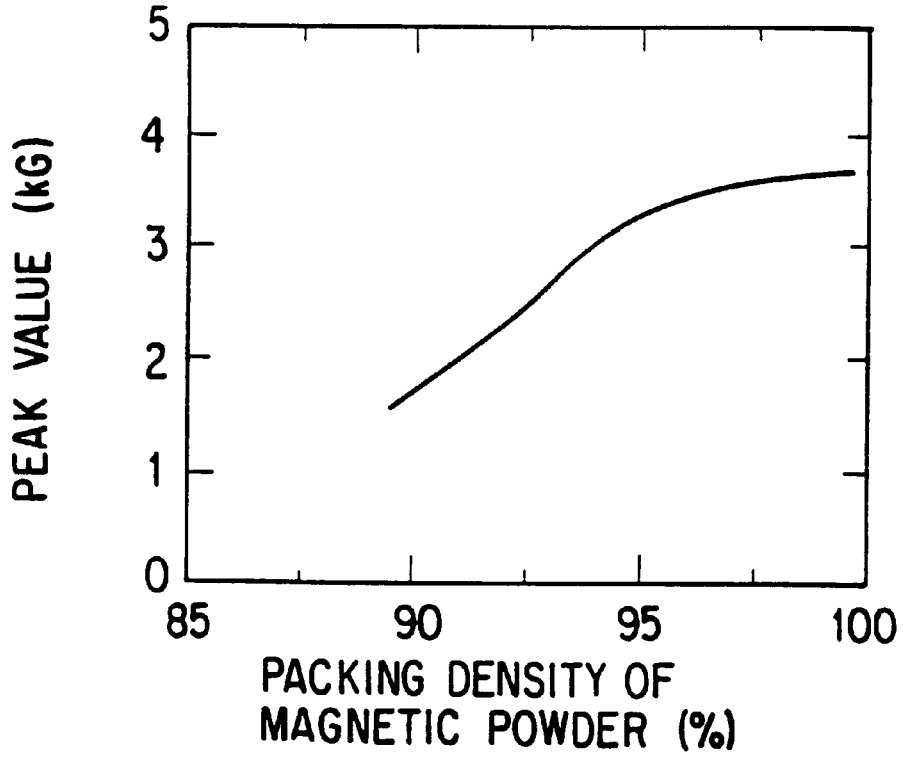
FIG. 12 shows the relationship between the peak value of the difference between measured and calculated magnetization for sintered magnets and the magnetic powder volume packing fraction.

The mixed powder prepared in Example 20 was molded in a magnetic field of 15 kOe at varied molding pressures. Sintered magnets were prepared from the molded body in the same manner as in Example 20. The packing density of magnetic powder was varied by varying the molding pressure as described above. The relationship between the packing density of magnetic powder and the peak value of the difference as an index of the magnetic interaction determined in Example 18 is shown in FIG. 12. As is apparent from the drawing, the peak value increased, that is, the squareness improved, with increasing the packing fraction. In particular, a rapid increase in the peak was observed when the packing density of magnetic powder was not less than 95%, illustrating that the packing fraction is critical to effective magnetic interaction.

Example 22

Melting and casing were carried out, resulting in the composition comprised 28.1 wt % of Nd, 60.2 wt % of Fe, 10.6 wt % of Co, 1.0 wt % of B and 0.1 wt % of Zr. The cast ingot was then subjected to a homogenization treatment and hydrogenated at 850° C. for 3 hrs. The system was evacuated to $10^{-3}$ Torr, and the body was rapidly cooled to room temperature., Thus, the so-called "HDDR" treatment was carried out. The resulting body was coarsely crushed to an average particle diameter of 200 $\mu$m. This powder was designated as "L1."

Powder L1 and Powder B1 were mixed together in a ratio of 3:2, and the mixture was further mixed and milled together with 1.6 wt % of an epoxy resin and molded in a magnetic field of 15 kOe. Thereafter, the molded body was cured at 150° C. for one hr to prepare a bonded magnet. The magnetic properties of the bonded magnet are shown below.

Br=10.5 kG iHc=12.4 kOe $(BH)_{max}$=21.5 MGOe

Example 23

Melting and casting were carried out so that the composition was $Fe_{65}CO_{35}$. the resultant ingot was pulverized. This powder was designated as "M1." Powder M1 and powder K1 were mixed together in a weight ratio of 1:9. the mixed powder was pulverized by means of a jet mill and molded in a magnetic field of 15 kOe. The molding was sintered at 1200° C. The sintered body was subjected to a solution heat treatment at 1130° C. for 24 hrs and aged at 800° C. for 12 hrs and continuously cooled to 400° C. at a rate of 0.5° C./min. The sintered magnet had the following magnetic properties.

Br=15.4 kG iHc=8.1 kOe $(BH)_{max}$=50.1 MGOe

Example 24

Powder M1 and powder A1 were mixed together in a the weight ratio of 2:8. The mixed powder was pulverized by means of a jet mill, mixed and milled together with 1.6 wt % of an epoxy resin and molded in a magnetic field of 15 kOe. Thereafter, the molding was cured at 150° C. for one hr to prepare a bonded magnet. The magnetic properties of the bonded magnet are shown below.

Br=13.8 kG iHc=6.2 kOe $(BH)_{max}$=25.4 MGOe

Example 25

Atomized Fe powder (average particle diameter is 2 μm) P1 and powder L1 were mixed together in a ratio of 1:9, and the mixed powder was mixed and kneaded together with 1.6 wt % of an epoxy resin and molded in a magnetic field of 15 kOe. Thereafter, the molded body was cured at 150° C. for one hr to prepare a bonded magnet. The magnetic properties of the bonded magnet are shown below.

Br=13.7 kG iHc=10.2 kOe $(BH)_{max}$=26.2 MGOe

Example 26

Melting and casting were carried out, resulting in the composition comprised 35 wt % of Sm and 65 wt % of Co. The ingot was coarsely crushed by means of jaw crusher and vibrating ball mill. The resultant powder was designated as "Q1." Powder Q1 and powder M1 were mixed together in a ratio of 7:3. The mixed powder was pulverized by means of jet mill, molded in a magnetic field of 15 kOe. The molded body was sintered at 1220° C. The sintered body was heat-treated at 850° C. for 5 hrs. The resultant sintered magnet had the following magnetic properties.

Br=14.3 kG iHc=12.5 kOe $(BH)_{max}$=42.1 MGOe

Example 27

An $\alpha$-$Fe_2O_3$/SrO value of 5.9, mixed together by means of a ball mill, pre-sintered at 1250° C. for 4 hrs and again pulverized by means of a ball mill. The resultant powder was designated as "R1." Powder R1 and powder K1 were mixed together in a ratio of 2:8, and the mixed ingot was pulverized by means of jet mill. The mixed powder was molded in a magnetic field of 15 kOe, and the molding was sintered at 1200° C. The sintered body was heat-treated at 1130° C. for 24 hrs and aged at 800° C. for 12 hrs and then continuously cooled to 400° C. at a rate of 0.5° C./min. The sintered magnet thus prepared had the following magnetic properties.

Br=13.5 kG iHc=10.2 kOe $(BH)_{max}$=39.2 MGOe

Example 28

Powder R1 and powder A1 were mixed together in a weight ratio of 3:7, and the mixture was pulverized by means of a jet mill. The mixed powder was mixed and kneaded together with 4 wt % of an epoxy resin and molded in a magnetic field of 15 kOe. Thereafter, the molded body was cured at 150° C. for one hr to prepare a bonded magnet. The magnetic properties of the bonded magnet are shown below.

Br=11.6 kG iHc=5.3 kOe $(BH)_{max}$=22.3 MGOe

Example 29

Powder R1 and powder L1 were mixed together in a ratio of 1:9, and the mixed powder was mixed and kneaded together with 1.6 wt % of an epoxy resin and molded in a magnetic field of 15 kOe. The molding was cured at 150° C. for one hr to prepare a bonded magnet. The magnetic properties of the bonded magnet are shown below.

Br=10.6 kG iHc=12.1 kOe $(BH)_{max}$=21.5 MGOe

Example 30

Powder R1 and powder M1 were mixed together in a weight ratio of 7:3. The mixed powder was pulverized by means of a jet mill and molded in a magnetic field of 15 kOe. The molded body was sintered at 1250° C. and heat-treated at 850° C. for 5 hrs. The resultant sintered magnet had the following magnetic properties.

Br=15.2 kG iHc=3.2 kOe $(BH)_{max}$=19.6 MGOe

Example 31

Fe was nitrided at 700° C. in an ammonia gas atmosphere and rapidly cooled to room temperature. The resultant iron nitride was rapidly cooled to liquid nitrogen temperature. It was then heat-treated at 100° C. to prepare $Fe_{16}N_2$. the alloy thus prepared was coarsely crushed. This powder was designated at "S1." Powder S2 and powder B1 were mixed together in a weight ratio of 1:9, and the mixed powder was mixed and milled together with 1.6 wt % of an epoxy resin and molded in a magnetic field of 15 kOe. Thereafter, the molding was cured at 150° C. for one hr to prepare a bonded magnet. The magnetic properties of the bonded magnet are shown below.

Br=11.6 kG iHc=6.2 kOe $(BH)_{max}$=20.9 MGOe

Example 32

Powder S2 and powder A1 were mixed together in a ration of 2:8, and the mixed powder was mixed and kneaded together with 1.6 wt % of an epoxy resin and molded in a magnetic field of 15 kOe. The molded body was cured at 150° C. for one hr to prepare a bonded magnet. The magnetic properties of the bonded magnet are shown below.

Br=10.7 kG iHc=10.6 kOe $(BH)_{max}$=22.3 MGOe

Example 33

Powder S1 and powder L1 were mixed together in a weight ratio of 3:17, and the mixed powder was mixed and kneaded together with 1.6 wt % of an epoxy resin and molded in a magnetic field of 15 kOe. The molding was cured at 150° C. for one hr to prepare a bonded magnet. The magnetic properties of the bonded magnet are shown below.

Br=10.7 kG iHc=10.6 kOe $(BH)_{max}$=22.3 MGOe

Example 34

Powder S1 and powder Q1 were mixed together in a ratio of 3:7, and the mixed powder was mixed and kneaded together with 1.6 wt % of an epoxy resin and molded in a magnetic field of 15 kOe. The molded body was cured at 150° C. for one hr to prepare a bonded magnet. The magnetic properties of the bonded magnet are shown below.

Br=11.1 kG iHc=4.7 kOe $(BH)_{max}$=17.1 MGOe

Example 35

Powder A1 and powder B1 were mixed together in a weight ratio of 1:3, 2.5 wt % of nylon 12 was added to the mixed powder, and they were kneaded together at 250° C. The mixture was pelletized by means of a pulverizer and molded into a magnetic field of 10 kOe at 250° C. to prepare a bonded magnet. In this case, the pressure was 1 ton/cm$^2$. The magnetic properties of the bonded magnet are shown below.

Br=10.5 kG iHc=10.3 kOe $(BH)_{max}$=22.4 MGOe

From the above results, it is understood that the molding at a relatively high temperature lead a bonded magnet having a sufficiently high alignment and a high packing density of magnetic powder even in a low magnetic field of alignment and at a low molding pressure.

Example 36

Powder A1 and powder B1 were mixed together in a ratio of 1:3, 10 wt % of nylon 12 was added to the mixed powder, and they were kneaded together at 280° C. The compound was injection-molded at 280° C. and an injection pressure of 1 ton/cm$^2$ in a magnetic field of 15 kOe. The magnetic properties of the bonded magnet thus prepared are shown below.

Br=8.5 kG iHc=9.8 kOe $(BH)_{max}$=15.7 MGOe

Example 37

Powder A1 and powder B1 were mixed together in a ratio of 1:3, and nylon 12, an antioxidant and a silicone oil were added thereto each in an amount of 3.2 wt %. They were milled together at 230° C. by means of a twin-screw kneader and, and the same time, pelletized. The mixture was extruded by means of an extruder in a magnetic field of 15 kOe. The magnetic properties of the extrudate are shown below.

Br=10.5 kG iHc=10.0 kOe $(BH)_{max}$=21.0 MGOe

Example 38

Figure 13:
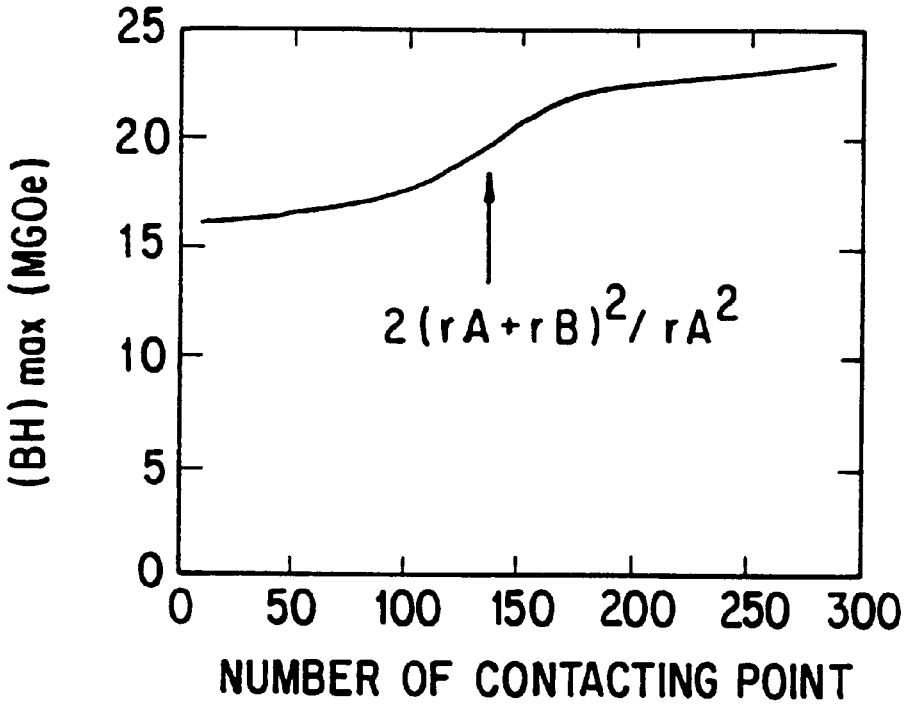
FIG. 13 shows the relationship between the number of contacting point of two magnetic powders and the maximum energy product.

Powder A1 and powder B1 were mixed together in a weight ratio of 1:3. The average particle diameters of powder A1 and powder B1 were respectively 2.0 μm (rA) and 21.0 μm (rB). The mixing was carried out by means of a twin-cylinder mixer with varied mixing times. The mixed powders were mixed and milled together with 1.6 wt % of an epoxy resin, and the resultant compound was molded in a magnetic filed of 15 kOe. The moldings were cured at 150° C. for one to prepare a bonded magnet. The sections of the bonded magnets were observed under a scanning electron microscope (SEM) to measure the number of contacting points of A1 with B1 (average for 10 points). The relationship between the number of contacting points and the magnetic property (maximum energy product) is shown in FIG. 13.

What is claimed is:

1. A bonded magnet produced from a magnetic powder comprising a mixture of at least two powders including:

a magnetic powder A having a residual magnetic flux density BrA and a coercive force HcA; and a magnetic powder B having a residual magnetic flux density BbR and a coercive force HcB, wherein the residual magnetic flux densities and said coercive forces of the magnetic powders A and B have the following relationships: Bra>BrB and HcA–HcB, and wherein the coercive forces of the magnetic powders A and B have the following relationship: HcA=y.HcB, where 0.1<y<1.

2. The bonded magnet according to claim 1, wherein the packing density of magnetic powder is not less than 50%.

3. A sintered magnet produced from a magnetic powder comprising a mixture of two or more powders including:

a magnetic powder A having a residual magnetic flux density BrA and a coercive force HcA, and a magnetic powder B having a residual magnetic flux density BrB and a coercive force HcB, wherein the residual magnetic flux densities and the coercive forces of the magnetic powders A and B have the following relationships: BrA>BrB and HcA<HcB, and wherein the coercive forces of the magnetic powders A and B have the following relationship: HcA=y.HcB, where 0.1<y<1.

4. The sintered magnet according to claim 3, wherein the packing density of magnetic powder is not less than 95%.

5. The bonded magnet according to claim 1, wherein said magnetic powder A comprises $R_2TM_{17}(NCH)_x$, and said magnetic powder B comprises $R_2TM_{17}$, where R is a rare earth metal, TM is a transition metal and x is a real number.

6. The bonded magnet according to claim 5, wherein said magnetic powder A has an average powder particle diameter rA and said magnetic powder B has an average powder particle diameter rB, and the average powder particle diameters rA and rB meet the relationship rA<rB.

7. A permanent magnet comprising a mixture of two or more powders including a magnetic powder A having a residual magnetic flux density BrA and a coercive force HcA and magnetic powder B having a residual magnetic flux density BrB and a coercive force HcB, wherein said residual magnetic flux densities and said coercive forces have the following relationships.

BrA>BrB and

HcA=y.HcB wherein 0.1<y<1.

8. A method of making a bonded magnet, comprising:

forming a powder mixture comprising at least two powders including:

a magnetic powder A having a residual magnetic flux density BrA and a coercive force HcA; and a magnetic powder B having a residual magnetic flux density BrB and a coercive force HcB, wherein the residual magnetic flux densities and said coercive forces of the magnetic powders A and B have the following relationships: BrA>BrB and HcA<HcB, and wherein the coercive forces of the magnetic powders A and B have the following relationship: HcA=y.HcB, where 0.1<y<1;

mixing and kneading the powder mixture with a binder;

magnetizing the powder mixture; and molding the magnetized powder mixture and binder.

9. The method of claim 8, wherein the powder mixture is formed by a process comprising:

separately pulverizing the magnetic powder A with the magnetic powder B.

10. The method of claim 8, wherein the powder mixture is formed by a process comprising:

pulverizing one of the magnetic powder A and the magnetic powder B; and then pulverizing the other of the magnetic powder A and the magnetic powder B while mixing the magnetic powder A with the magnetic powder B.

11. The method of claim 8, wherein the powder mixture is formed by a process comprising simultaneously pulverizing and mixing together the magnetic powder A and the magnetic powder B.

12. A method of making a sintered magnet, comprising:

forming a powder mixture comprising a mixture of two or more powders including:

a magnetic powder A having a residual magnetic flux density BrA and a coercive force HcA, and a magnetic powder B having a residual magnetic flux density BrB and a coercive force HcB, wherein the residual magnetic flux densities and the coercive forces of the magnetic powders A and B have the following relationships: BrA>BrB and HcA<HcB, and wherein the coercive forces of the magnetic powders A and B have the following relationship: HcA=y.HcB, where 0.1<y<1;

mixing and kneading the powder mixture with a binder;

magnetizing the powder mixture;

molding the magnetized powder mixture and binder; and sintering the molded magnetized powder mixture and binder.

13. The method of claim 12, wherein the powder mixture is formed by a process comprising:

separately pulverizing the magnetic powder A and the magnetic powder B; and then mixing the magnetic powder A with the magnetic powder B.

14. The method of claim 12, wherein the powder mixture is formed by a process comprising:

pulverizing one of the magnetic powder A and the magnetic powder B; and then pulverizing the other of the magnetic powder A and the magnetic powder B while mixing the magnetic powder A with the magnetic powder B.

15. The method of claim 12, wherein the powder mixture is formed by a process comprising simultaneously pulverizing and mixing together the magnetic powder A and the magnetic powder B.

* * * * *

UNITED STATES PATENT AND TRADEMARK OFFICE

CERTIFICATE OF CORRECTION

PATENT NO. : 6,139,765

DATED : October 31, 2000

INVENTOR(S) : Atsunori KITAZAWA, Toshiyuki ISHIBASHI and Koji AKIOKA

It is certified that error appears in the above-identified patent and that said Letters Patent is hereby corrected as shown below:

Claim 1, line 6, change "BbR" to --BrB--;

line 9, change "Bra > BrB" to --BrA > BrB--;

change "HcA—HcB" to --HcA < HcB--; and line12, change "HcA = y.HcB" to --HcA = y · HcB--.

Claim 3, line 12, change "HcA = y.HcB" to --HcA = y · HcB--.

Claim 7, line 9, change "HcA = y.HcB" to --HcA = y · HcB--.

Claim 8, line 13, change "HcA = y.HcB" to --HcA = y · HcB--.

Claim 12, line 13, change "HcA = y.HcB" to --HcA = y · HcB--.

Signed and Sealed this

Eighth Day of May, 2001

*Attest:*

Nicholas P. Godici

NICHOLAS P. GODICI

*Attesting Officer*

*Acting Director of the United States Patent and Trademark Office*